US009845218B2

(12) United States Patent
Izumichi et al.

(10) Patent No.: US 9,845,218 B2
(45) Date of Patent: Dec. 19, 2017

(54) FOLDING DEVICE, POST-PROCESSING DEVICE AND IMAGE FORMING APPARATUS

(71) Applicant: KYOCERA DOCUMENT SOLUTIONS INC., Osaka-shi (JP)

(72) Inventors: Sachio Izumichi, Osaka (JP); Seiichi Shirasaki, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 566 days.

(21) Appl. No.: 14/386,700

(22) PCT Filed: Jan. 15, 2013

(86) PCT No.: PCT/JP2013/050590
§ 371 (c)(1),
(2) Date: Sep. 19, 2014

(87) PCT Pub. No.: WO2013/140834
PCT Pub. Date: Sep. 26, 2013

(65) Prior Publication Data

US 2015/0080201 A1 Mar. 19, 2015

(30) Foreign Application Priority Data

Mar. 22, 2012 (JP) ..... 2012-066355
Mar. 22, 2012 (JP) ..... 2012-066356

(51) Int. Cl.
*B65H 45/04* (2006.01)
*B65H 45/18* (2006.01)
(Continued)

(52) U.S. Cl.
CPC ..... *B65H 45/04* (2013.01); *B65H 37/06* (2013.01); *B65H 43/00* (2013.01); *B65H 45/18* (2013.01);
(Continued)

(58) Field of Classification Search
USPC ..... 493/442
See application file for complete search history.

(56) References Cited

U.S. PATENT DOCUMENTS

2007/0063409 A1* 3/2007 Sugimoto ..... B65H 45/18 270/58.09
2008/0315489 A1* 12/2008 Iguchi ..... B42C 1/12 270/37
(Continued)

FOREIGN PATENT DOCUMENTS

JP 2008-184324 A 8/2008
JP 2008-247535 A 10/2008

*Primary Examiner* — Michelle Lopez
*Assistant Examiner* — Chinyere Rushing-Tucker
(74) *Attorney, Agent, or Firm* — Knobbe Martens Olson & Bear LLP

(57) ABSTRACT

A folding device includes a conveying path, a placement portion, a through portion, a first folding member, a second folding member, a rotational driving unit, a rotational position detecting mechanism, a signal receiving unit, and a rotational drive control unit. The rotational drive control unit, when the signal receiving unit receives a signal, determines whether the first folding member is in a state of moving from an initial position to a protruded position or in a state of moving to the opposite direction, and, in a case of being determined to be in the state of moving from the initial position to the protruded position, controls the rotational driving unit to reverse the direction of rotational drive, and in a case of being determined to be in the state of moving to the opposite direction, controls the rotational driving unit to maintain the direction of rotational drive.

9 Claims, 20 Drawing Sheets

(51) Int. Cl.
*B65H 37/06* (2006.01)
*B65H 43/00* (2006.01)

(52) U.S. Cl.
CPC .... *B65H 2403/512* (2013.01); *B65H 2801/27* (2013.01)

(56) References Cited

U.S. PATENT DOCUMENTS

| | | | | |
|---|---|---|---|---|
| 2009/0200724 | A1* | 8/2009 | Iguchi | B65H 37/04 270/8 |
| 2009/0218760 | A1* | 9/2009 | Kamiya | B65H 37/04 271/226 |
| 2009/0221412 | A1* | 9/2009 | Kawaguchi | B65H 37/04 493/444 |
| 2010/0119276 | A1* | 5/2010 | Sasahara | B65H 45/18 399/407 |
| 2010/0320673 | A1* | 12/2010 | Takata | B42B 4/00 270/37 |
| 2011/0221115 | A1* | 9/2011 | Fukatsu | B65H 45/18 270/32 |
| 2011/0281708 | A1* | 11/2011 | Kato | B65H 45/18 493/443 |
| 2011/0293336 | A1* | 12/2011 | Noso | G03G 15/1615 399/302 |
| 2012/0035032 | A1* | 2/2012 | Decker | B65H 9/14 493/18 |
| 2013/0307206 | A1* | 11/2013 | Izumichi | B65H 39/00 270/45 |

* cited by examiner

610

| ROTATION STATE | DETECTION STATE | BLADE STATE (POSITION) | TYPE OF DRIVING CONTROL |
|---|---|---|---|
| POSITIVE ROTATION | NOT DETECTED | BETWEEN INITIAL POSITION AND PROTRUDED POSITION | NEGATIVE ROTATION |
| POSITIVE ROTATION | NOT DETECTED →DETECTED | PROTRUDED POSITION | POSITIVE ROTATION (MAINTAINED) |
| POSITIVE ROTATION | DETECTED | BETWEEN PROTRUDED POSITION AND INITIAL POSITION | POSITIVE ROTATION (MAINTAINED) |
| POSITIVE ROTATION | DETECTED→ NOT DETECTED | INITIAL POSITION | STOP |
| NEGATIVE ROTATION | NOT DETECTED →DETECTED | OVER PASSING INITIAL POSITION | STOP |

FIG. 4B

FOLDING DEVICE, POST-PROCESSING DEVICE AND IMAGE FORMING APPARATUS

CROSS-REFERENCE TO RELATED APPLICATIONS

This application is the U.S. National Phase under 35. U.S.C. §371 of International Application PCT/JP2013/050590, filed Jan. 15, 2013, which claims priority to Japanese Patent Application No. 2012-066355, filed Mar. 22, 2012, and Japanese Patent Application No. 2012-066356, filed Mar. 22, 2012. The disclosures of the above-described applications are hereby incorporated by reference in their entirety. The International Application was published under PCT Article 21(2) in a language other than English.

TECHNICAL FIELD

The present invention relates to a folding device that can fold a sheet member such as a sheet-like image formation target material, a post processing device, and an image forming apparatus provided with the post processing device.

BACKGROUND ART

Conventionally, a post processing device that can be connected to an image forming apparatus main body of a copy machine, a multi-function peripheral and the like has existed. The post processing device performs predetermined post processing on a sheet (or a stack of sheets) having been discharged from the image forming apparatus main body. As the post-processing, punching processing on the sheet, staple processing on the stack of sheets, and processing on the sheet (the stack of sheets) can be exemplified.

The post processing device with a folding function has a blade and a pair of rollers. The blade is brought into contact with a sheet (a stack of sheets) to fold. The pair of rollers pinches and receives the sheet (the stack of sheets) thus folded as well as the blade to thereby make a fold.

Here, in a folding process, the blade may be loaded and damaged with a certain type and number of sheets (stacks of sheets).

In order to address this, an image forming apparatus has been proposed that is provided with a clutch means which drives a pair of rollers to be rotatable in a state in which a blade and a sheet (a stack of sheets) are inserted between the rollers (refer to Patent Document 1).

In addition, an image forming apparatus has been proposed that is configured to be capable of adjusting a crimping force between the rollers in a state in which a blade and a sheet (a stack of sheets) are inserted between the rollers (refer to Patent Document 2).

Patent Document 1: Japanese Unexamined Patent Application Publication No. 2008-184324

Patent Document 2: Japanese Unexamined Patent Application Publication No. 2008-247535

DISCLOSURE OF THE INVENTION

Problems to be Solved by the Invention

However, the blade may be damaged in the image forming apparatus disclosed in Patent Document 1 or Patent Document 2. In this case, the post processing device stops the processing operation in a state in which the blade is inserted between the rollers. A load of an operation of bringing this state back to a normal state is extremely high.

The present invention is aimed at providing a post processing device that suppresses damage of the folding member and that can reduce an operator's burden in a case of failure.

In addition, the present invention aims at providing an image forming apparatus provided with the post processing device.

Means for Solving the Problems

The present invention relates to a folding device including a conveying path, a placement portion, a through portion, a first folding member, a second folding member, a driving mechanism, a rotational position detecting mechanism, a signal receiving unit, and a rotational drive control unit.

The conveying path is configured to be capable of conveying a sheet member in a predetermined conveying direction.

The placement portion constitutes a part of the conveying path and has a placement face on which the sheet member can be placed.

The through portion is formed on the placement portion and formed to be through from the placement face side to an opposite face on an opposite side of the placement face.

The first folding member is arranged on the opposite face side in the placement portion, to be movable between an initial position where a tip end part thereof is positioned at a predetermined position on the opposite face side and a protruded position where the tip end part penetrates the through portion and is positioned at a predetermined position on the placement face side, the first folding member folding and moving the sheet member by moving from the initial position to the protruded position in a state in which the sheet member is placed thereon.

The second folding member is arranged on the placement face side of the placement portion, and pinches and receives the sheet member thus folded as well as the first folding member in a state in which the first folding member is positioned at the protruded position.

The driving mechanism includes a rotational driving unit that can output a rotational driving force and a rotating member that is rotated by the rotational driving force from the rotational driving unit, the driving mechanism making the first folding member reciprocate between the initial position and the protruded position.

The rotational position detecting mechanism detects a rotational position of the rotating member and outputs rotational position information.

The signal receiving unit receives a predetermined signal.

The rotational drive control unit receives the rotational position information from the rotational position detecting mechanism.

The driving mechanism can output the rotational driving force. The driving mechanism includes a converting unit that converts a rotational motion of the rotating member into a reciprocating motion.

The rotational driving unit can reverse a direction of the rotational drive.

The rotating member is directly or indirectly connected to the rotational driving unit.

The rotational drive control unit, when the signal receiving unit receives the predetermined signal, determines whether the first folding member is in a state of moving from the initial position to the protruded position or the first folding member is in a state of moving from the protruded position to the initial position based on the rotational position information. The rotational drive control unit, in a case in which the first folding member is determined to be in the state of moving from the initial position to the protruded position, controls the rotational driving unit to reverse the direction of rotational drive, and in a case in which the first folding member is determined to be in the state of moving from the protruded position to the initial position, controls the rotational driving unit to maintain the direction of rotational drive.

The present invention relates to a folding device including a conveying path, a placement portion, a through portion, a first folding member, a second folding member, a driving mechanism, a rotational position detecting mechanism, a rotational load monitoring unit, and a rotational drive control unit.

The conveying path is configured to be capable of conveying a sheet member in a predetermined conveying direction.

The placement portion constitutes a part of the conveying path and has a placement face on which the sheet member can be placed.

The through portion is formed on the placement portion and formed to be through from the placement face side to an opposite face on an opposite side of the placement face.

The first folding member is arranged on the opposite face side in the placement portion, to be movable between an initial position where a tip end part thereof is positioned at a predetermined position on the opposite face side and a protruded position where the tip end part penetrates the through portion and is positioned at a predetermined position on the placement face side, the first folding member folding and moving the sheet member by moving from the initial position to the protruded position in a state in which the sheet member is placed thereon.

The second folding member is arranged on the placement face side of the placement portion, and pinches and receives the sheet member thus folded as well as the first folding member in a state in which the first folding member is positioned at the protruded position.

The driving mechanism includes a rotational driving unit that can output a rotational driving force and a rotating member that is rotated by the rotational driving force from the rotational driving unit, the driving mechanism making the first folding member reciprocate between the initial position and the protruded position.

The rotational position detecting mechanism detects a rotational position of the rotating member and outputs rotational position information.

The rotational load monitoring unit detects a rotational load generated in the rotational driving unit and determines whether the rotational load is at least a predetermined load.

The rotational drive control unit receives the rotational position information from the rotational position detecting mechanism.

The driving mechanism can output the rotational driving force. The driving mechanism includes a converting unit that converts a rotational motion of the rotating member into a reciprocating motion.

The rotational driving unit can reverse a direction of the rotational drive.

The rotating member is directly or indirectly connected to the rotational driving unit.

The rotational drive control unit, when the rotational load monitoring unit determines that the rotational load is at least the predetermined load, determines whether the first folding member is in a state of moving from the initial position to the protruded position or the first folding member is in a state of moving from the protruded position to the initial position based on the rotational position information. The rotational drive control unit, in a case in which the first folding member is determined to be in the state of moving from the initial position to the protruded position, controls the rotational driving unit to reverse the direction of rotational drive, and in a case in which the first folding member is determined to be in the state of moving from the protruded position to the initial position, controls the rotational driving unit to maintain the direction of rotational drive.

BRIEF DESCRIPTION OF THE DRAWINGS

FIG. 4B is a diagram explaining a table stored in a storage unit;

EXPLANATION OF REFERENCE NUMERALS

1 Copy machine (Image forming apparatus)

Figure 1:
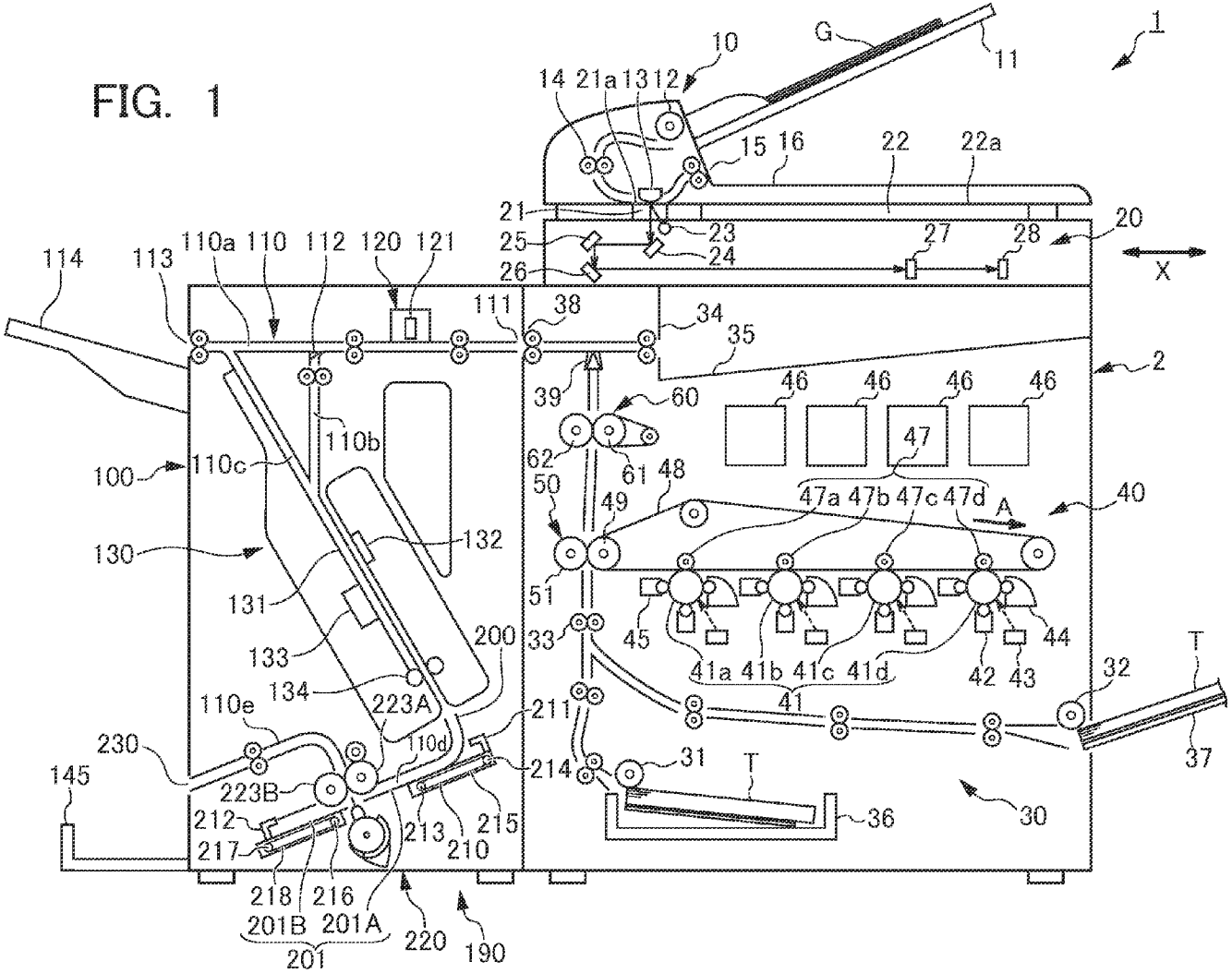
FIG. 1 is a diagram for explaining an overall configuration of a copy machine of a first embodiment.

2 Copy machine main body (Image forming apparatus main body)

100 Post processing device

110 Second paper conveying unit (Conveying unit)
201 Sheet placement member (Placement portion)
204 Through portion
222 Blade member (First folding member)
223 Pair of folding rollers (Second folding member)
300 Driving mechanism
310 Cam mechanism (Converting unit)
350 Rotating member
360 Rotational drive unit
365 Signal receiving unit
366 Rotational load monitoring unit
370 Rotational drive control unit
400 Rotational position detecting mechanism
HP Initial position
TP Protruded position
T Paper (Image formation target material, sheet member)

DETAILED DESCRIPTION OF THE INVENTION

First Embodiment

A copying machine 1 according to a first embodiment of an image forming apparatus of the present invention will be described hereafter making reference to the figures. Firstly, the overall configuration of the copying machine 1 will be described. FIG. 1 is a diagram for explaining an overall configuration of a copy machine of a first embodiment.

A copy machine 1 is provided with a copy machine main body 2 (image forming apparatus main body) and a post processing device 100. The copy machine main body 2 (image forming apparatus main body) forms a toner image onto paper T. The post processing device 100 is disposed on a paper discharging side of the copy machine main body 2. The post processing device 100 performs punching processing, staple processing, and fold processing on the paper (image formation target material, sheet member) T on which a toner image is formed.

The copy machine main body 2 includes an original conveying unit 10, an original scanning unit 20, a first paper conveying unit 30, a toner image forming unit 40, a transfer unit 50, and a fusing unit 60.

The original conveying unit 10 is an ADF (auto document feeder), and includes an original placement portion 11, a first roller 12, a guide 13, a pair of timing rollers 14, and an original discharging unit 15. The first roller 12 supplies an original G mounted on the original placement portion 11 sheet by sheet to the pair of timing rollers 14. The pair of timing rollers 14 conveys the original G or stops the conveyance of the original G in order to make the timing of the scanning of the original G by the original scanning unit 20 coincide with the timing of supplying the original G to the position for scanning of the original G by the original scanning unit 20 (position at which the guide 13 is disposed). The guide 13 introduces the conveyed original G to the first scanning surface 21*a* as described above. The original discharging unit 15 discharges an original G read by the original scanning unit 20 (passed through the guide 13) to the outside of the copy machine main body 2.

An original collection unit 16 is formed on an outer side of the copy machine main body 2 in the original discharging unit 15. An original G discharged from the original discharging unit 15 is stacked and collected in the original collection unit 16.

The original scanning unit 20 includes a first scanning surface 21*a* and a second scanning surface 22*a*. The first scanning surface 21*a* is formed along the upper surface of a first contact glass 21. The first contact glass 21 is arranged to oppose the guide 13. The first scanning surface 21*a* is a face that scans an original G. The second scanning surface 22*a* is disposed adjacently to the first scanning surface 21*a*. The second scanning surface 22*a* is disposed along the majority of a right side of the first scanning surface 21*a*, in a configuration shown in FIG. 1. The second scanning surface 22*a* is used when scanning an original G without using the original conveying unit 10. The second scanning surface 22*a* is formed along the upper surface of a second contact glass 22. The original G is placed on the second contact glass 22. The second scanning surface 22*a* is a face that scans the original G.

The original scanning unit 20 is provided with an illumination unit 23, a first mirror 24, a second mirror 25, a third mirror 26, an imaging lens 27, and an image capture unit 28. The illumination unit 23, the first mirror 24, the second mirror 25, the third mirror 26, the imaging lens 27, and the image capture unit 28 are provided in an inner portion of the copy machine main body 2. The illumination unit 23 and the first mirror 24 move respectively in a sub-scanning direction X. The first mirror 25 and the third mirror 26 are disposed on the left side of the illumination unit 23 and the first mirror 24 in FIG. 1. Furthermore, the second mirror 25 and the third mirror 26 respectively move in the sub-scanning direction X while maintaining a fixed distance (optical path length) from the first scanning surface 21*a* or the second scanning surface 22*a* to the image capture unit 28. The distance (optical path length) from the first scanning surface 21*a* or the second scanning surface 22*a* to the image capture unit 28 is a distance passing through the first mirror 24, the second mirror 25, the third mirror 26, and the imaging lens 27.

The illumination unit 23 is a light source that illuminates light onto the original G. The first mirror 24, the second mirror 25, and the third mirror 26 are mirrors that maintain a fixed optical path length while introducing light reflected by the original G to the imaging lens 27. The imaging lens 27 images light that is incident from the third mirror 26 onto the image capture unit 28. The image capture unit 28 is provided with a plurality of imaging devices. The plurality of imaging devices is arrayed along a horizontal scanning direction (a direction that is orthogonal to the sub-scanning direction X). The imaging devices are devices for obtaining image data based on a focused light image by converting the incident light to an electrical signal, and for example may be a charge coupled device (CCD) or the like.

The first paper conveying unit 30 includes a second feed roller 31, a third feed roller 32, a pair of registration rollers 33, a switching unit 39, a first paper discharging unit 34, and a second paper discharging unit 38. The second feed roller 31 supplies the paper T contained in a paper feeding cassette 36 to the transfer unit 50. The third feeding roller 32 supplies the paper T placed on the manual feed tray 37 to the transfer unit 50. The pair of registration rollers 33 conveys the paper T or stops the conveyance of the paper T in order to make the timing of the forming of a toner image on the transfer unit 50 coincide with the timing of supplying the paper T to the transfer unit 50. The pair of registration rollers 33 corrects skew (inclination of the supplied sheet) of the paper T. The switching unit 39 reverses a conveying direction of the paper T so as to convey the paper T having been discharged from the fusing unit 60 to one of the first paper discharging unit 34 and the second paper discharging unit 38. The first paper discharging unit 34 and the second paper discharging unit 38 discharges the paper T having a toner image fused thereonto to an external side of the copy machine main body 2. A discharged paper collection unit 35 is formed in the first paper discharging unit 34, on an external side of the copy machine main body 2. The paper T discharged from the first paper discharging unit 34 is stacked and collected in the discharged paper collection unit 35.

The toner image forming unit 40 includes a photosensitive drum 41, a charging member 42, a laser scanning unit 43, a developing unit 44, a cleaning unit 45, a toner cartridge 46, a primary transfer roller 47, an intermediate transfer belt 48, and a counter roller 49.

The photosensitive drum 41 (41*a*, 41*b*, 41*c*, 41*d*) functions as a photosensitive body or an image supporting body to form respective toner images of black, cyan, magenta and yellow. The charging member 42, a laser scanner unit 43, a developing unit 44, and a cleaning unit 45 are disposed in order from upstream to downstream along the rotation direction of the photosensitive drum 41 in the periphery of each photosensitive drum 41*a*, 41*b*, 41*c*, and 41*d*. The charging member 42 applies a charge to the surface of the photosensitive drum 41. The laser scanner unit 43 is disposed away from a surface of the photosensitive drum 41. The laser scanning unit 43 scans and exposes the surface of the photosensitive drum 41 based on the image data related to the original G having been read by the original scanning unit 20. In this manner, a charge on the exposed portion on the surface of the photosensitive drum 41 is removed to thereby form an electrostatic latent image. The developing unit 44 attaches toner to the electrostatic latent image formed on the surface of the photosensitive drum 41 to thereby form a toner image. After the surface of the photosensitive drum 41 is destaticized by a destaticizing device (not shown), the cleaning unit 45 removes residual toner and the like from the surface of the photosensitive drum 41 having been destaticized.

The toner cartridge 46 contains respective colors of toner supplied to the developing unit 44. The toner cartridge 46 and the developing unit 44 are connected by a toner supply passage (not shown).

The primary transfer rollers 47 (47*a*, 47*b*, 47*c*, 47*d*) are respectively disposed opposite each photosensitive drum 41*a*, 41*b*, 41*c*, 41*d* in the intermediate transfer belt 48. The intermediate transfer belt 48 is a belt passing through the toner image forming unit 40 and the transfer unit 50. A part of the intermediate transfer belt 48 is pinched between each photosensitive drum 41*a*, 41*b*, 41*c*, 41*d* and each primary transfer roller 47*a*, 47*b*, 47*c*, 47*d*. Primary transfer of a toner image formed on the surface of each photosensitive drum 41*a*, 41*b*, 41*c*, 41*d* is executed onto the part of the intermediate transfer belt 48. The counter roller 49 is disposed on an inner side of the annular intermediate transfer belt 48. The counter roller 49 is a drive roller that propels the intermediate transfer belt 48 in the direction of an arrow A shown in FIG. 1.

The transfer unit 50 includes a secondary transfer roller 51. The secondary transfer roller 51 is disposed on an opposite side of the counter roller 49 in the intermediate transfer belt 48. The secondary transfer roller 51 and the counter roller 49 pinch the part of the intermediate transfer belt 48. The secondary transfer roller 51 executes secondary transfer of the toner image, which has been subjected to primary transfer onto the intermediate transfer belt 48, onto the paper T.

The fusing unit 60 includes a heating rotating body 61 and a pressuring rotating body 62. The heating rotating body 61 and the pressuring rotating body 62 pinch the paper T that includes the toner image having been subjected to the secondary transfer, to thereby melt and pressurize the toner, and fuse that toner onto the paper T.

The post processing device 100 is configured to be connectable to the copy machine main body 2. The post processing device 100 is provided with a second paper conveying unit 110 (conveying path), a punching unit 120, a stapling unit 130, and a folding unit 190.

The second paper conveying unit 110 has a conveying path 110*a*, a conveying path 110*b*, a conveying path 110*c*, a conveying path 110*d*, and a conveying path 110*e*. The second paper conveying unit 110 is configured to be capable of conveying the sheet-like paper T in a predetermined conveying direction.

The conveying path 110*a* is provided with an introduction unit 111, a branching guide 112, and a first discharging unit 113.

The introduction unit 111 introduces the paper T having been discharged from the second paper discharging unit 38 of the copy machine main body 2 into the post processing device 100. The introduction unit 111 conveys the paper T having been introduced into the post processing device 100 to the punching unit 120.

The branching guide 112 switches the conveying direction of the paper T having been discharged from the punching unit 120 to one of the first discharging unit 113 and the stapling unit 130.

The first discharging unit 113 discharges the paper T having been discharged from the punching unit 120 and the paper T having been discharged from the stapling unit 130, from the post processing device 100.

A main tray 114 is disposed in the first discharging unit 113, on an external side of the post processing device 100. The paper T having been discharged from the first discharging unit 113 is stacked and collected in the main tray 114.

The punching unit 120 performs a series of processes relating to punching processing. The punching processing is processing for forming a hole for binding the paper T at a predetermined position on the paper.

The stapling unit 130 is a unit for binding the paper T by means of a staple (stapling processing). The stapling unit 130 is provided with a paper receiving tray 131, a receiving unit 132, a staple processing unit 133, and a conveying roller 134. Here, the paper receiving tray 131, the receiving unit 132 and the conveying roller 134 compose a part of the conveying path 110*c*.

The paper receiving tray 131 temporarily retains a plurality of sheets of paper T having been introduced from the punching unit 120 by switching of the branching guide 112.

The receiving unit 132 receives and retains a lower end part of the paper T having been introduced to the paper receiving tray 131.

The stapling processing unit 133 moves to the vicinity of an edge part or a central part of the paper T being retained on the paper receiving tray 131 and performs stapling processing in the vicinity of the edge part or the central part of the paper T.

The conveying roller 134 conveys a stack of paper having been stapled (saddle stitched) in the vicinity of the central part thereof from the paper receiving tray 131 to the folding processing unit 190.

The folding processing unit 190 double-folds the stack of paper having been, for example, saddle stitched, from the vicinity of the central part (folding processing). The folding processing unit 190 is described in detail hereafter.

The folding processing unit 190 in the post processing device 100 (folding device) according to the present embodiment is described with reference to FIGS. 2 to 3B.

Figure 2:
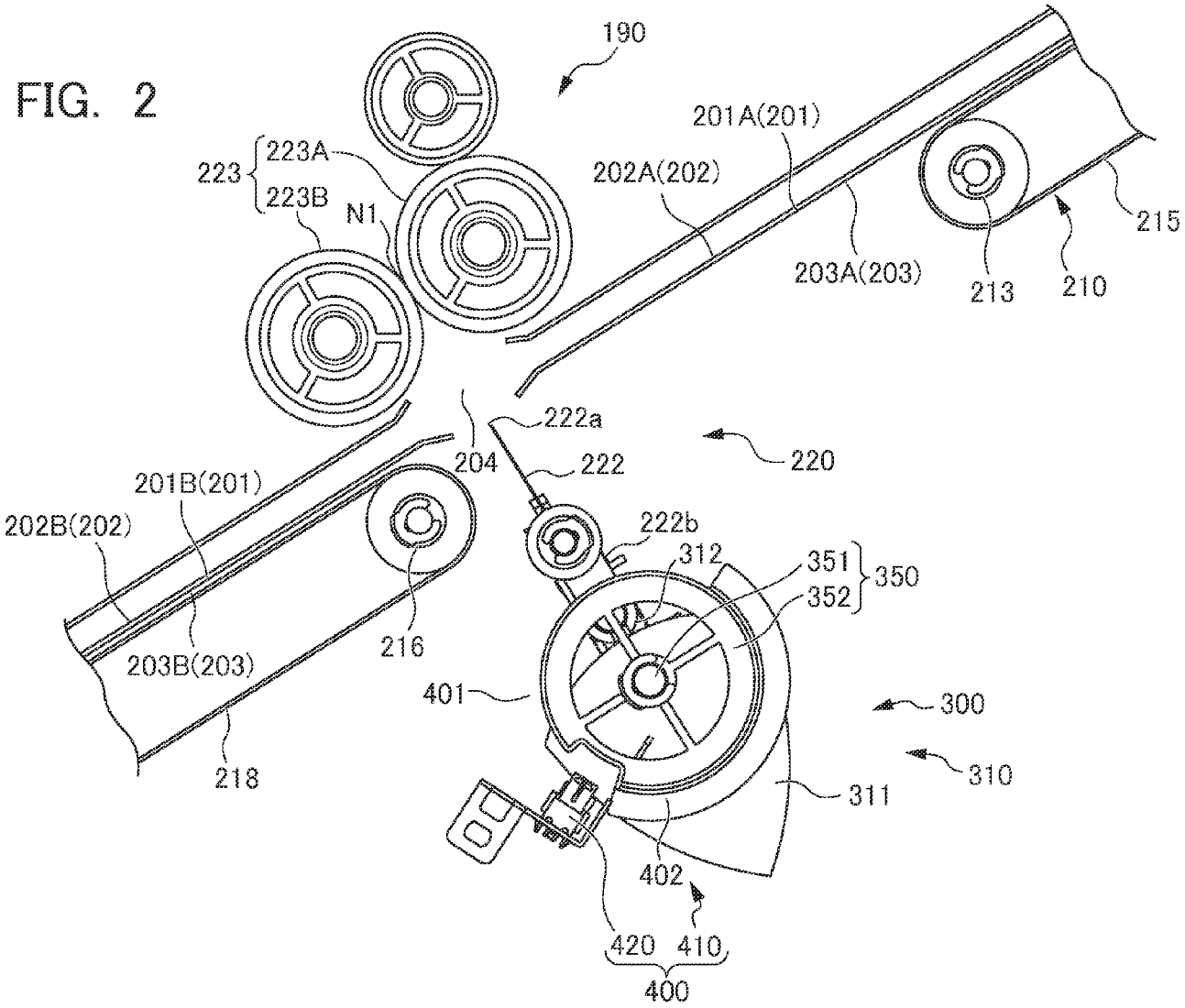
FIG. 2 is a diagram explaining a configuration of a folding processing unit that composes a post processing device.
Figure 3A:
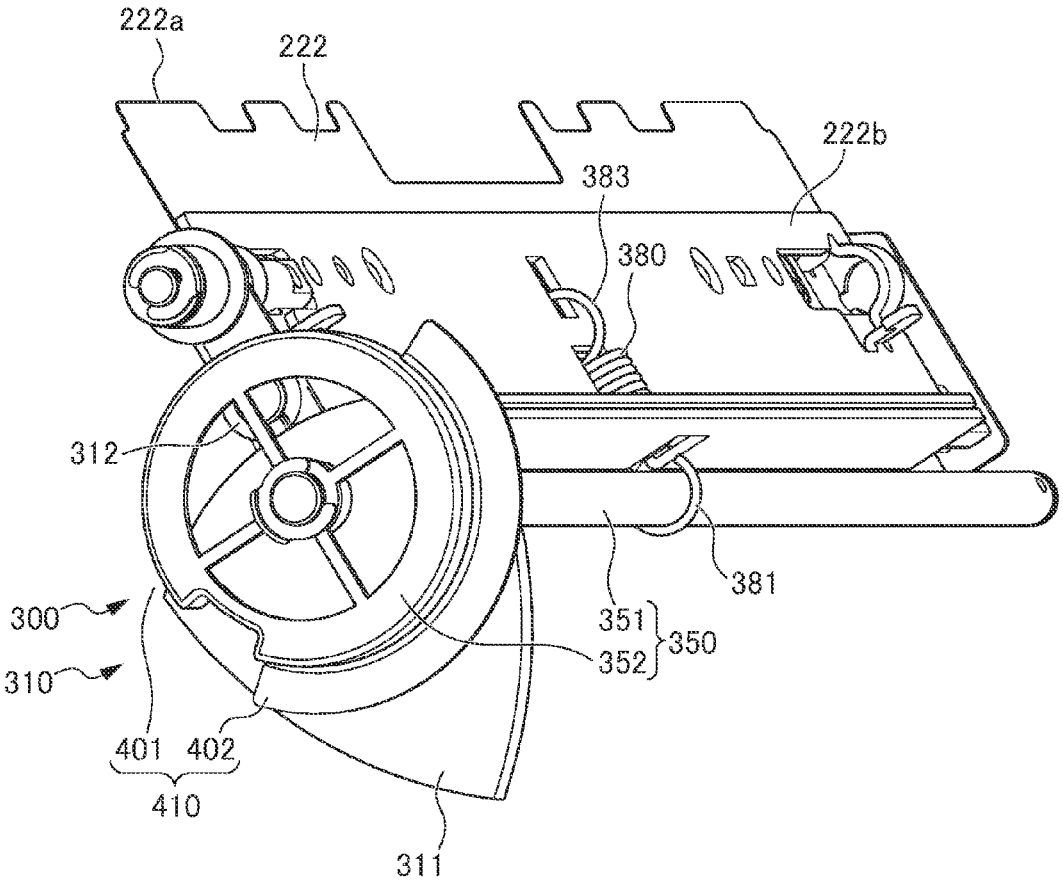
FIG. 3A is a diagram explaining a cam mechanism that composes the folding processing unit.
Figure 3B:
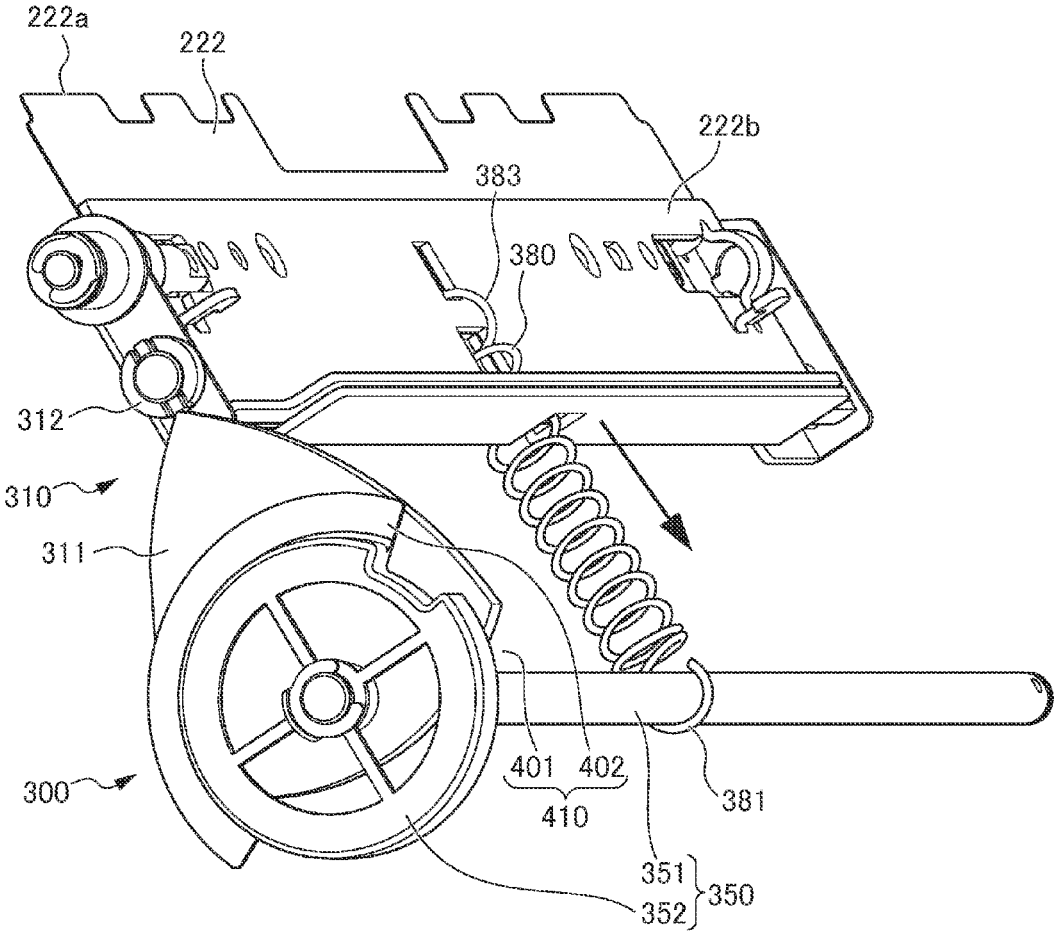
FIG. 3B is a diagram explaining a cam mechanism that composes the folding processing unit.

FIG. 2 is a diagram explaining a configuration of a folding processing unit that composes a post processing device. FIG. 3A is a diagram explaining a cam mechanism that composes the folding processing unit. FIG. 3B is a diagram explaining a cam mechanism that composes the folding processing unit. In the following description, "paper T" shall be considered to include a stack of the paper T, for the sake of convenience.

As shown in FIG. 1, the folding processing unit 190 is disposed on a downstream side of the second paper conveying unit 110. Into the folding processing unit 190, for example, a sheet of paper T or a stack of paper T having been stapled is introduced. The folding processing unit 190 performs the folding processing on the paper T having been introduced. And then, the folding processing unit 190 discharges the paper T thus folded to a lower discharging tray 145. The lower discharging tray 145 is provided in a lower part of a side face of the post processing device 100.

The folding processing unit 190 is provided with: a sheet introduction path 200; a sheet placement member 201 (placement portion) with a sheet placement face 202 (placement face); a through portion 204; an alignment portion 210; a pushing member 211; a receiving member 212; a folding portion 220; and a second discharging unit 230.

The sheet introduction path 200 is a path for introducing the paper T, having been conveyed on the conveying path, into the folding processing unit 190. As shown in FIG. 1, the sheet introduction path 200 is disposed in an upper part of a right side of the folding processing unit 190. The sheet introduction path 200 conveys the paper T toward the sheet placement member 201 (sheet placement face 202).

The sheet placement member 201 composes a part of the conveying path 110*d* (second paper conveying unit 110). The sheet placement member 201 includes the sheet placement face 202 on which the sheet-like paper T can be placed.

The sheet placement member 201 is provided with the upstream sheet placement member 201A, the downstream sheet placement member 201B, and the through portion 204.

The upstream sheet placement member 201A includes an upstream sheet placement face 202A. The downstream sheet placement member 201B includes a downstream sheet placement face 202B.

The upstream sheet placement member 201A and the downstream sheet placement member 201B are members on which the paper T is placed for performing the folding processing on the paper T having been introduced.

The upstream sheet placement member 201A and the downstream sheet placement member 201B are disposed to extend from an upper right side to a lower left side of an inner part of the folding processing unit 190. The upstream sheet placement member 201A and the downstream sheet placement member 201B are disposed across the through portion 204 (described later).

The upstream sheet placement member 201A and the downstream sheet placement member 201B are composed of plate-like members. The upstream sheet placement member 201A and the downstream sheet placement member 201B are disposed in line in the sheet conveying direction.

The paper T placed on the upstream sheet placement member 201A and the downstream sheet placement member 201B is fed into a first nip N1 of the pair of folding rollers 223 by a blade member 222 (described later in detail) penetrating the through portion 204.

The through portion 204 is formed to penetrate the sheet placement face 202 to an opposite face 203 side that is on an opposite side of the sheet placement face 202.

The through portion 204 is disposed between the upstream sheet placement member 201A and the downstream sheet placement member 201B.

The through portion 204 is a through hole through which the blade member 222 penetrates.

The alignment portion 210 is provided to align the paper T on the upstream sheet placement member 201A and the downstream sheet placement member 201B, so as to accurately perform the folding processing on the paper T having been introduced. The alignment portion 210 aligns the paper T in a direction parallel to the conveying direction of the paper T (left downward direction in FIG. 1) and in a direction orthogonal to conveying direction of the paper T.

As shown in FIG. 1, the pushing member 211 and the receiving member 212 are provided to align a front end and a rear end of the paper T in the conveying direction of the paper T. The pushing member 211 is disposed on an upstream side in the conveying direction of the sheet. The receiving member 212 is disposed on a downstream side in the conveying direction of the sheet.

The pushing member 211 is formed to have a cross-section that is substantially L-shaped. In addition, a driving pulley 213 and a driven pulley 214 are disposed below the upstream sheet placement member 201A. An endless belt 215 is stretched around the driving pulley 213 and the driven pulley 214. The pushing member 211 is attached to the endless belt 215. In addition, the pushing member 211 projects from above the upstream sheet placement member 201A at a substantially central position in the width direction of the upstream sheet placement member 201A.

The driving pulley 213 is disposed at a position corresponding to the substantially central position of the upstream sheet placement member 201A in the sheet conveying direction. The driven pulley 214 is disposed in the vicinity of an upstream end of the upstream sheet placement member 201A. A rotational driving force from a motor (not shown) is transferred to the driving pulley 213 by a driving mechanism (not shown). The driving pulley 213 and the driven pulley 214 can rotate back and forth. As the driving pulley 213 rotates, the driven pulley 214 is driven to rotate via the endless belt 215. This makes the pushing member 211 project from an upper part of the upstream sheet placement member 201A and move in a direction parallel to the sheet conveying direction.

The receiving member 212 is formed to have a cross-section that is substantially L-shaped. In addition, a driving pulley 216 and a driven pulley 217 are disposed below the downstream sheet placement member 201B. An endless belt 218 is stretched around the driving pulley 216 and the driven pulley 217. The receiving member 212 is attached to the endless belt 218. In addition, the receiving member 212 projects from above the downstream sheet placement member 201B at a substantially central position in the width direction of the downstream sheet placement member 201B.

The driving pulley 216 is disposed in the vicinity of an upstream end of the downstream sheet placement member 201B. The driven pulley 217 is disposed in the vicinity of a downstream end of the downstream sheet placement member 201B. A rotational driving force from a motor (not shown) is transferred to the driving pulley 216, by a driving mechanism (not shown). The driving pulley 216 and the driven pulley 217 can rotate back and forth. As the driving pulley 216 rotates, the driven pulley 217 is driven to rotate via the endless belt 218. This makes the receiving member 212 project from above the downstream sheet placement member 201B and move along an entire length of the downstream sheet placement member 201B, in a direction parallel to the sheet conveying direction.

By moving the pushing member 211 and the receiving member 212 according to a size of the paper T (a length thereof in the conveying direction), the paper T introduced into the upstream sheet placement member 201A and the downstream sheet placement member 201B is aligned in a direction parallel to the sheet conveying direction, in other words a longitudinal direction of the paper T.

Widthwise alignment members (not illustrated) are members for aligning the paper T in a direction orthogonal to the conveying direction of the paper T, in other words in the width direction of the paper T. The widthwise alignment members are provided in pair in a direction parallel to the conveying direction of the paper T. The pair of widthwise alignment members is arranged above the upstream sheet placement member 201A and the downstream sheet placement member 201B, across the blade member 222 in the sheet conveying direction, with an interval therebetween in the width direction. The pair of widthwise alignment members performs widthwise alignment and skew compensation of the paper T. The pair of widthwise alignment members is provided above the upstream sheet placement member 201A. The pair of widthwise alignment members has a rack and pinion mechanism (not illustrated). The rack and pinion mechanism is driven in connection with a motor (not illustrated) that can rotate back and forth.

The rack and pinion mechanism and the motor move the widthwise alignment member according to a size (a length in the width direction) of the paper T having been introduced onto the upstream sheet placement member 201A and the downstream sheet placement member 201B. Alignment such as widthwise alignment and skew compensation of the paper T is thus performed.

The folding portion 220 forms a fold on the paper T at the first nip N1 (described later). The folding portion 220 dispatches the paper T on which the fold has been formed toward the second discharging unit 230.

The folding portion 220 is provided with a blade member 222 (first folding member) and a pair of folding rollers 223 (second folding member). In addition, the folding portion 220 has a driving mechanism 300 and a rotational position detecting mechanism 400.

The blade member 222 is a member that is brought into contact with the paper T to thereby perform the folding processing on the paper T.

The blade member 222 has a tip end part 222*a* that is brought into contact with the paper T. An edge part of the blade member 222 that is on an opposite side to the tip end part 222*a* is held by a holding member 222*b*.

The blade member 222 is disposed on the opposite face 203 side, which is opposite to the sheet placement face 202, of the sheet placement member 201. The blade member 222 is disposed to be movable between an initial position HP (refer to FIG. 6) and a protruded position TP (refer to FIG. 8). At the initial position HP (refer to FIG. 6), the tip end part 222*a* of the blade member 222 is positioned at a predetermined position on the opposite face 203 side. At the protruded position TP (refer to FIG. 8), the tip end part 222*a* of the blade member 222 penetrates the through portion 204 and is positioned at a predetermined position on the sheet placement face 202 side.

The blade member 222 folds and moves the paper T by moving from the initial position HP to the protruded position TP in a state in which the paper T is placed on the sheet placement member 201.

More specifically, the blade member 222 is brought into contact with the paper T so as to push out the paper T, and bends (folds) and feeds the paper T into the first nip N1 (described later). The blade member 222 moves in a direction which is substantially orthogonal to the sheet placement face 202 including the sheet conveying direction and the sheet width direction.

The pair of folding rollers 223 is disposed on the sheet placement face 202 side of the sheet placement member 201. In the present embodiment, the pair of folding rollers 223 is disposed above the blade member 222.

The pair of folding rollers 223 includes a first roller 223A and a second roller 223B. Both of the first roller 223A and the second roller 223B constituting the pair of folding rollers 223 are rotationally driven via a rotational driving mechanism which is not illustrated.

The first nip N1 is formed between the first roller 223A and the second roller 223B.

The pair of folding rollers 223 pinches and receives the paper T thus folded as well as the blade member 222 in a state in which the blade member 222 is positioned at the protruded position TP.

The driving mechanism 300 is a driving mechanism that makes the blade member 222 reciprocate between the initial position HP and the protruded position TP.

The driving mechanism 300 includes a rotational driving unit 360 (refer to FIG. 4), a rotating member 350 (refer to FIG. 2), and a cam mechanism 310 (converting unit).

The rotational driving unit 360 can output a rotational driving force. The rotational driving unit 360 is configured to be capable of reversing a direction of the rotational drive. The rotational driving unit 360 is configured to include, for example, a motor.

The rotational driving unit 360 is configured to be capable of reversing a rotational direction between a positive rotational direction, which is a normal rotational direction, and a negative rotational direction, which is a rotational direction opposite to the positive rotational direction.

Figure 4A:
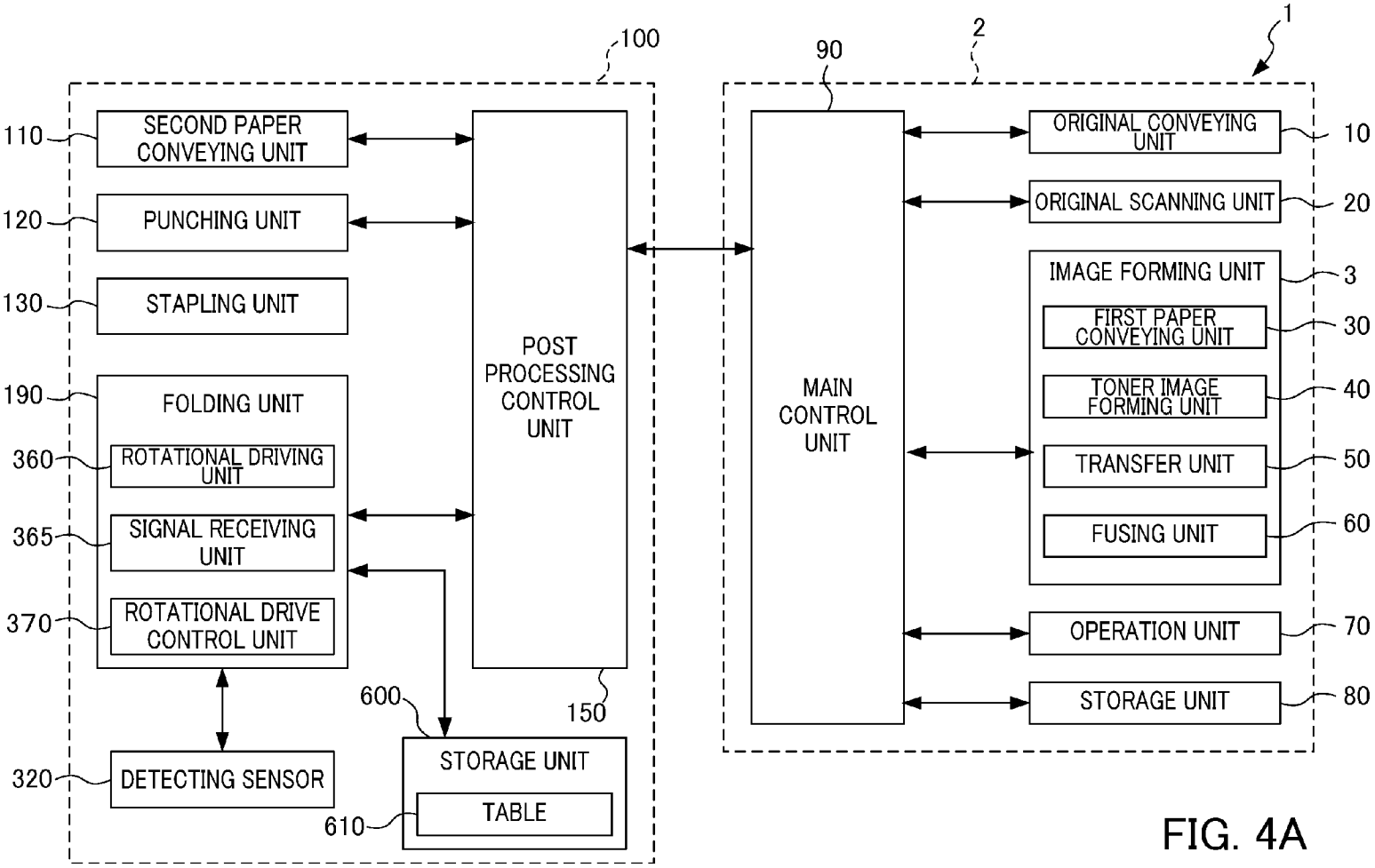
FIG. 4A is a block diagram showing a functional configuration in a copy machine (post processing device) of the first embodiment.

The rotational driving unit 360 is controlled by the rotational drive control unit 370 (described later, refer to FIG. 4A). For example, in a case in which the rotational drive control unit 370 (drive control unit) receives a predetermined signal and determines that the blade member 222 is in a state of moving from the initial position HP to the protruded position TP, the rotational driving unit 360 is controlled by the rotational drive control unit 370 to reverse the direction of rotational drive.

Alternatively, in a case in which the rotational drive control unit 370 (drive control unit) receives a predetermined signal and determines that the blade member 222 is in a state of moving from the protruded position TP to the initial position HP, the rotational driving unit 360 is controlled by the rotational drive control unit 370 to maintain the direction of rotational drive.

Here, the predetermined signal is a signal that is output in a case in which a jam detection unit (not illustrated) detects a paper jam, a signal that is output when a monitoring unit for monitoring a load in the rotational driving unit 360 (not illustrated) detects an overload, and the like.

In addition, the rotational driving unit 360 is controlled by the rotational drive control unit 370 to stop the rotational drive, for example in a case in which the rotational drive control unit 370 detects that the blade member 222 is positioned at the initial position HP based on rotational position information received from the rotational position detecting mechanism 400 (described later).

The rotating member 350 is directly or indirectly connected to the rotational driving unit 360.

The rotating member 350 includes a shaft member 351 and a rotating plate member 352 that is connected to an end of the shaft member 351.

The rotating member 350 is rotated by the rotational driving force from the rotational driving unit 360.

In other words, the shaft member 350 is rotated by the rotational driving force from the rotational driving unit 360. And the rotating plate member 352 is rotated by the rotational driving force from the rotational driving unit 360, via the shaft member 351.

The cam mechanism is a driving mechanism that converts a rotational motion of the rotating member 350 into a reciprocating motion. The cam mechanism 310 converts the rotational motion into the reciprocating motion in such a way that, as the rotating member 350 makes one rotation, the blade member 222 makes one reciprocation.

The cam mechanism 310 includes a cam member 311, a contacting member 312, and a spring member 380. The cam member 311 is connected to the shaft member 351 in the rotating member 350. The cam member 311 rotates integrally with the rotating member 350.

The contacting member 312 is formed on the holding member 222*b*. The holding member 222*b* holds the blade member 222. The contacting member 312 is disposed to be in contact with an external edge of the cam member 311. The contacting member 312 is configured to reciprocate as the cam member rotates. Here, the holding member 222*b* on which the contacting member 312 is formed holds the blade member 222. As a result, the blade member 222 reciprocates as the contacting member 312 reciprocates.

A first end 381 of the spring member 380 is connected to the shaft member 351. A second end 383 of the spring member 380 is connected to the holding member 222*b*. The spring member 380 biases the contacting member 312 toward the cam member 311, via the shaft member 351 and the holding member 222*b*.

The spring member 380 maintains a state in which the contacting member 312 is in contact with the external edge of the cam member 311.

The rotational position detecting mechanism 400 detects a rotational position of the rotating member 350. The rotational position detecting mechanism 400 outputs rotational position information.

The rotational position detecting mechanism 400 includes a detected portion 410 and a detecting sensor 420.

The detected portion 410 is disposed on an external edge of the rotating plate member 352 constituting the rotating member 350. The detected portion 410 includes a first region 401 (transparent region) and a second region 402 (non-transparent region).

The first region 401 is a region that is positioned at a measured position of the detecting sensor 420 which is described later, in a state in which the blade member 222 is positioned between the initial position HP and a position immediately before the protruded position TP. In the present embodiment, the first region 401 is a region that transmits light that is output from the detecting sensor 420.

The second region 402 is a region that is positioned at the measured position of the detecting sensor 420 which is described later, in a state in which the blade member 222 is positioned between the protruded position TP and a position immediately before the initial position HP. In the present embodiment, the second region 402 is a region that does not transmit light that is output from the detecting sensor 420 (non-transparent region, light shielding region).

It should be noted that a mode of the detected portion 410 is not limited to the above mentioned mode.

The detecting sensor 420 is disposed at a position corresponding to the detected portion 410.

The detecting sensor 420 detects detection information (position information) relating to the detected portion 410. In addition, the detecting sensor 420 outputs the detection information (position information) thus detected. In other words, the detecting sensor 420 detects a rotational position of the rotating member 350 (rotating plate member 352) and outputs the rotational position information (position information).

Next, the functional configuration of the copy machine 1 will be described with reference to FIGS. 4A and 4B. FIG. 4A is a block diagram showing a functional configuration in a copy machine (post processing device) of the first embodiment. FIG. 4B is a diagram explaining a table stored in a storage unit.

The copy machine main body 2 is provided with the above described constituent features (the original conveying unit 10, the original scanning unit 20, the first paper conveying unit 30, the toner image forming unit 40, the transfer unit 50, and the fusing unit 60). An image forming unit 3 is configured from the first paper conveying unit 30, the toner image forming unit 40, the transfer unit 50, and the fusing unit 60. Description of the constituent elements that have been described above will be omitted. In addition to the above-mentioned functional configuration, the copy machine main body 2 further includes an operation unit 70, a storage unit 80, and a main control unit 90.

The operation unit 70 includes a numeric keypad (not shown), a touch panel (not shown), a start key (not shown), and the like. The numeric keypad is operated for input of numerals related to print copy number and the like. The touch panel displays a plurality of keys to which various functions are assigned. As the various functions, a function for setting the copy magnification, a function for allocating a plurality of pages to a single sheet of paper T (2 in 1, and the like), a function for executing the punching processing, the stapling processing or the fold processing can be exemplified. The keys displayed on the touch panel are operated (by touch) in order to execute any of the various functions on the copy machine 1. The start key is operated to execute printing. In response to operation of any of the keys, the operation unit 70 supplies a signal expressing operation of the key to the control unit 90.

The storage unit 80 is configured from a hard disk, semiconductor memory, and the like. The storage unit 80 stores image data based on the original G read by the original scanning unit 20. In addition, the storage unit 80 stores a control program used in the copy machine 1, data used by the control program, and the like.

The main control unit 90 controls the original conveying unit 10, the original scanning unit 20, the image forming unit 3, the touch panel constituting the operation unit 70, and a post processing control unit 150.

The post processing device 100 is provided with the above described constituent elements (the second paper conveying unit 110, the punching unit 120, the stapling unit 130, and the folding unit 190). Description of the constituent elements that have been described above will be omitted. The post processing device 100 is further provided with, in addition to the above described constituent elements, the post processing control unit 150 and a storage unit 600.

The folding unit 190 includes the rotational driving unit 360, a signal receiving unit 365, and the rotational drive control unit 370. The rotational driving unit 360 is as described above.

The signal receiving unit 365 receives a predetermined signal. After receiving a predetermined signal, the signal receiving unit 365 notifies the rotational drive control unit 370 of the reception.

Here, the signal is, as described above, a signal that is output in a case in which a jam detection unit (not illustrated) detects a paper jam, a signal that is output when a monitoring unit for monitoring a load in the rotational driving unit 360 (not illustrated) detects an overload, and the like.

The rotational drive control unit 370 controls the rotational driving unit 360.

The rotational drive control unit 370 receives the rotational position information from the rotational position detecting mechanism 400 (detecting sensor 420).

In addition, the rotational drive control unit 370 receives the abovementioned notification from the signal receiving unit 365.

The rotational drive control unit 370, when the signal receiving unit 365 receives the predetermined signal (when the notification from the signal receiving unit 365 is received), determines whether the blade member 222 is in a state of moving from the initial position HP to the protruded position TP or the blade member 22 is in a state of moving from the protruded position TP to the initial position HP based on the rotational position information thus received.

And then, in a case in which the blade member 222 is determined to be in the state of moving from the initial position HP to the protruded position TP, the rotational drive control unit 370 controls the rotational driving unit 360 to reverse the direction of rotational drive.

In a case in which the blade member 222 is determined to be in the state of moving from the protruded position TP to the initial position HP, the rotational drive control unit 370 controls the rotational driving unit 360 to maintain the direction of rotational drive.

Furthermore, after performing the abovementioned control, in a case in which the blade member 222 is determined to be positioned at the initial position HP based on the rotational position information, the rotational drive control unit 370 controls the rotational driving unit 360 to stop the rotational drive.

Here, as described above, the rotational drive control unit 370 determines whether the blade member 222 is in a state of moving from the initial position HP to the protruded position TP or the blade member 22 is in a state of moving from the protruded position TP to the initial position HP based on the rotational position information thus received.

The rotational drive control unit 370 makes the abovementioned determination based on the rotational position information thus received, with reference to the table 610 stored in the storage unit 600 which is described later.

The table 610 stored in the storage unit 600 stores a (current) rotational status, a detection status, a blade status (position), and a type of driving control, in association with each other.

In the present embodiment, in a case in which the rotational position information including information not "detected" is received from the detecting sensor 420, the rotational drive control unit 370 determines that the blade member 222 is in the state of moving from the initial position HP to the protruded position TP. And then, the rotational drive control unit 370 controls the rotational driving unit 360 to reverse the direction of the rotational drive.

In the present embodiment, in a case in which the rotational position information including information "detected" is received from the detecting sensor 420, the rotational drive control unit 370 determines that the blade member 222 is in the state of moving from the protruded position TP to the initial position HP. And then, the rotational drive control unit 370 controls the rotational driving unit 360 to maintain the direction of the rotational drive.

In addition, after the above described control, if the rotational direction of the rotational driving unit 360 is the positive rotation, when the rotational drive control unit 370 detects that the information received from the detecting sensor 420 is changed from "detected" to "not detected", the blade member 222 is detected to be positioned at the initial position HP. And then, the rotational drive control unit 370 controls the rotational driving unit 360 to stop the rotational drive.

Furthermore, after the above described control, if the rotational direction of the rotational driving unit 360 is the negative rotation, when the rotational drive control unit 370 detects that the information received from the detecting sensor 420 is changed from "not detected" to "detected", the blade member 222 is detected to have slightly overpassed the initial position HP. And then, the rotational drive control unit 370 controls the rotational driving unit 360 to stop the rotational drive.

Here, a case in which the initial position HP is positioned not on the edge part of the first region 401, but more inward than the edge part of the first region 401 is described.

After the above described control, if the rotational direction of the rotational driving unit 360 is the positive rotation, when the rotational drive control unit 370 detects that the information received from the detecting sensor 420 is changed from "detected" to "not detected", the rotational drive control unit 370 controls the rotational driving unit 360 to stop the rotational drive after further making a predetermined amount of positive rotation.

After the above described control, if the rotational direction of the rotational driving unit 360 is the negative rotation, when the rotational drive control unit 370 detects that the information received from the detecting sensor 420 is changed from "not detected" to "detected", the rotational drive control unit 370 controls the rotational driving unit 360 to stop the rotational drive in the negative rotation and to make a predetermined amount of positive rotation.

Next, the operation of the copy machine 1 will be described. Here, a case of performing post processing after copying of an original G placed on the original placement portion 11 will be described.

The control unit 90 detects the operation of the start key when a signal is supplied that indicates that the start key constituting the operation unit 70 has been operated. Then, the control unit 90 drives the first roller 12 of the original conveying unit 10 to thereby supply the original G to the first scanning surface 21*a*. The control unit 90 produces image data based on the original G supplied to the first scanning surface 21*a* by the original scanning unit 20. The main control unit 90 temporarily stores the image data thus generated by the original scanning unit 20 in the storage unit 80. The control unit 90 forms a toner image on the paper T based on the image data temporarily stored in the storage unit 80. The main control unit 90 controls the first paper conveying unit 30 constituting the image forming unit 3, the toner image forming unit 40, the transfer unit 50, and the fusing unit 60, respectively. In other words, the main control unit 90 drives the second roller 31 or the third roller 32 to convey the paper T to the transfer unit 50. In addition, the control unit 90 supplies color image data produced for each color based on the image data to the respective laser scanning units 43. The main control unit 90 forms an electrostatic latent image on the photosensitive drum 41 by means of the laser light submitted from the laser scanning units 43. The main control unit 90 forms a toner image on the photosensitive drum 41 using the developing unit 44. The main control unit 90 subjects the toner image thus formed on the photosensitive drum 41 to primary transfer onto the intermediate transfer belt 48. The control unit 90 uses the secondary transfer roller 51 to perform secondary transfer of the toner image having been subjected to the primary transfer to the intermediate transfer belt 48 onto the paper T. The main control unit 90 controls the heating rotating body 61 to be heated to a predetermined temperature. The main control unit 90 melts toner in the toner image having been subjected to secondary transfer to the paper T. The main control unit 90 fuses the toner onto the paper T by the pressurizing rotating body 62 that is brought into pressure contact with the heating rotating body 61. Furthermore, the main control unit 90 uses the first paper conveying unit 30 to discharge the paper T onto which the toner image is fused from the second paper discharging unit 38.

The main control unit 90 controls the post processing control unit 150 to perform the post processing on the paper T being discharged from the second paper discharging unit 38.

The post processing control unit 150 introduces the paper T having been discharged from the second paper discharging unit 38 to the post processing device 100 by means of the second paper conveying unit 110. And then, the post processing control unit 150 stops the conveyance of the paper T by the second paper conveying unit 110 at the punching unit 120.

The post processing control unit 150 lowers a punching processing unit (not illustrated) of the punching unit 120 toward the paper T. The post processing control unit 150 thus forms a punched hole on the paper T. The post processing control unit 150 conveys the paper T, on which the punched hole is formed, by means of the second paper conveying unit 110. The post processing control unit 150 discharges the paper T having been conveyed by the second paper conveying unit 110 from the first discharging unit 113.

In a case of performing the stapling processing, the post processing control unit 150 makes the branching guide 112 reverses the conveying direction of the paper T having been introduced into the post processing device 110 to a direction orthogonal to the conveying direction of the paper T. As a result, the post processing control unit 150 temporarily retains the paper T at the paper receiving tray 131. The post processing control unit 150 moves the stapling processing unit 133 when a predetermined number of sheets of the paper T is temporarily retained at the paper receiving tray 131. The post processing control unit 150 then makes the stapling processing unit 133 perform the stapling processing in the vicinity of the edge part or the central part of the paper T. In a case in which the stapling processing unit 133 has performed the stapling processing in the vicinity of the edge part of the paper T, the post processing control unit 150 discharges a stack of paper having been stapled from the first discharging unit 113. On the other hand, in a case in which the stapling processing unit 133 has performed the stapling processing in the vicinity of the central part of the paper T, the post processing control unit 150 conveys a stack of paper having been saddle stitched to the folding processing unit 190 (the sheet placement member 201).

In the folding processing, the rotational drive control unit 370 controls the rotational driving unit 360 to move the blade member 222 toward the stack of paper (paper T) placed on the sheet placement member 201 (sheet placement face 202). The blade member 222 is thus moved toward the pair of folding rollers 223 while folding the stack of paper. The blade member 222 tucks the stack of paper thus folded into the first nip N1. The post processing control unit 150 then folds the stack of paper by means of the pair of folding rollers 223. Furthermore, the post processing control unit 150 controls various driving units (not illustrated) to convey the stack of paper thus folded toward the second discharging unit 230.

Next, the folding processing (operation) of the folding processing unit 190 in post processing device 100 is described with reference to FIGS. 5 to 12.

Figure 5:
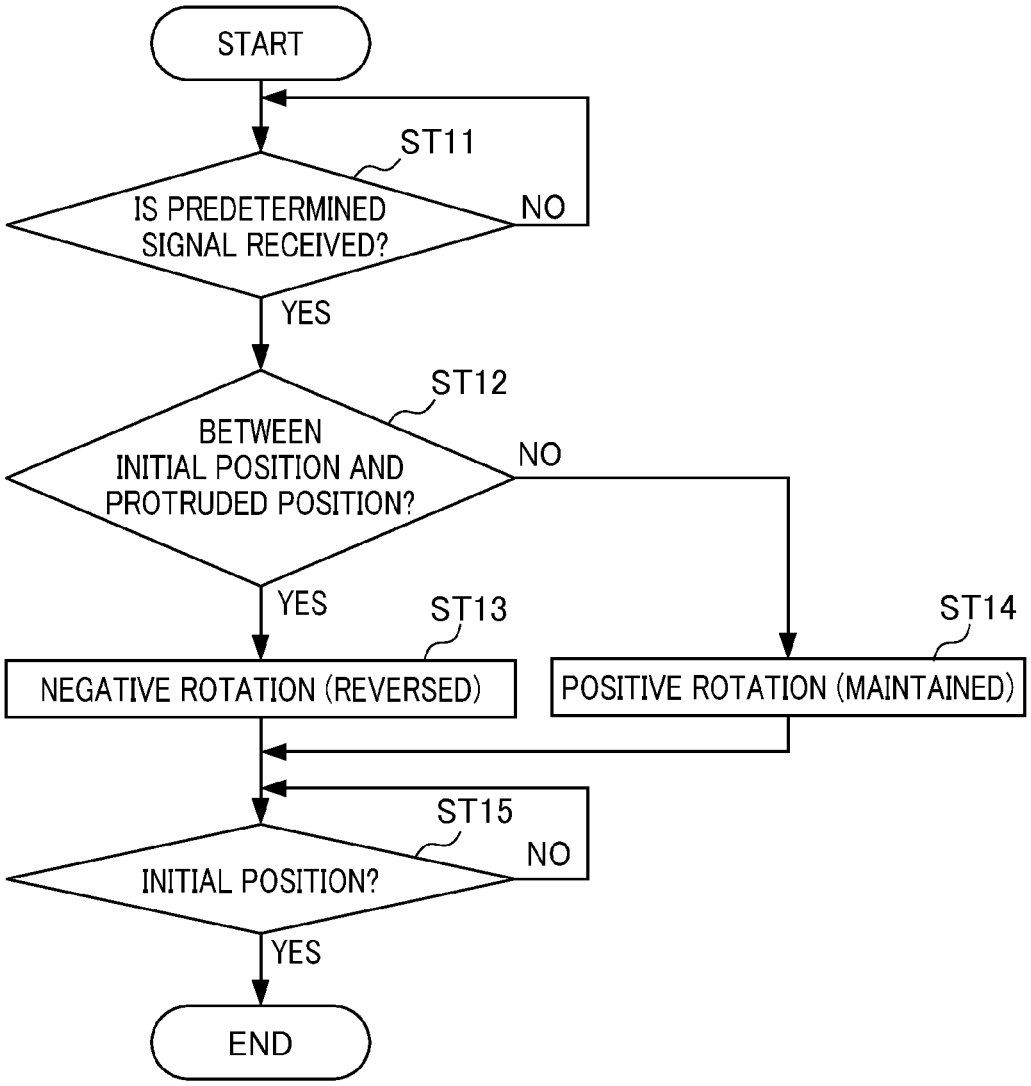
FIG. 5 is a flow chart explaining an operation in the folding processing unit in the copy machine of the first embodiment.
Figure 6:
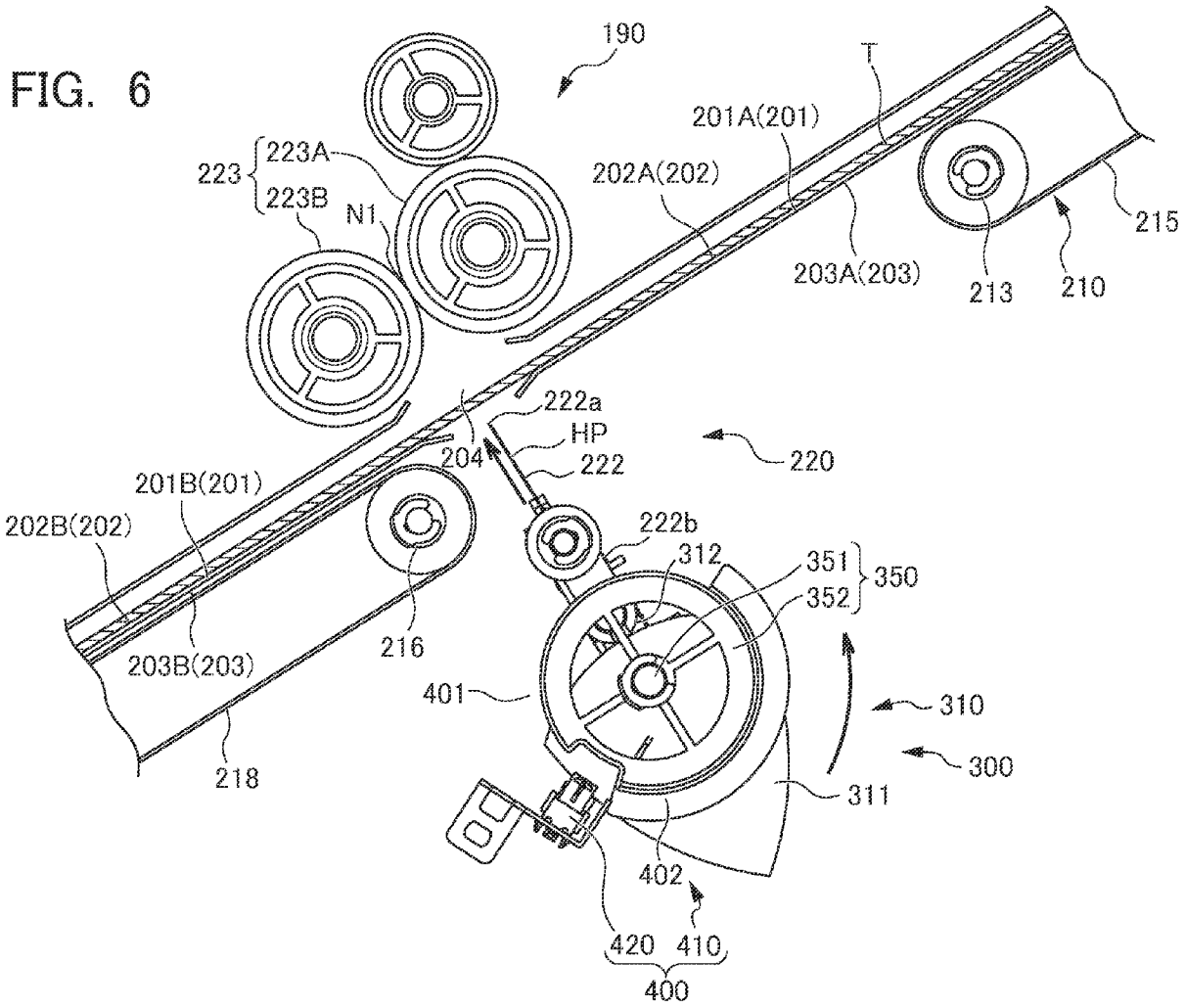
FIG. 6 is a diagram explaining a state in which a blade is positioned at an initial position.
Figure 7:
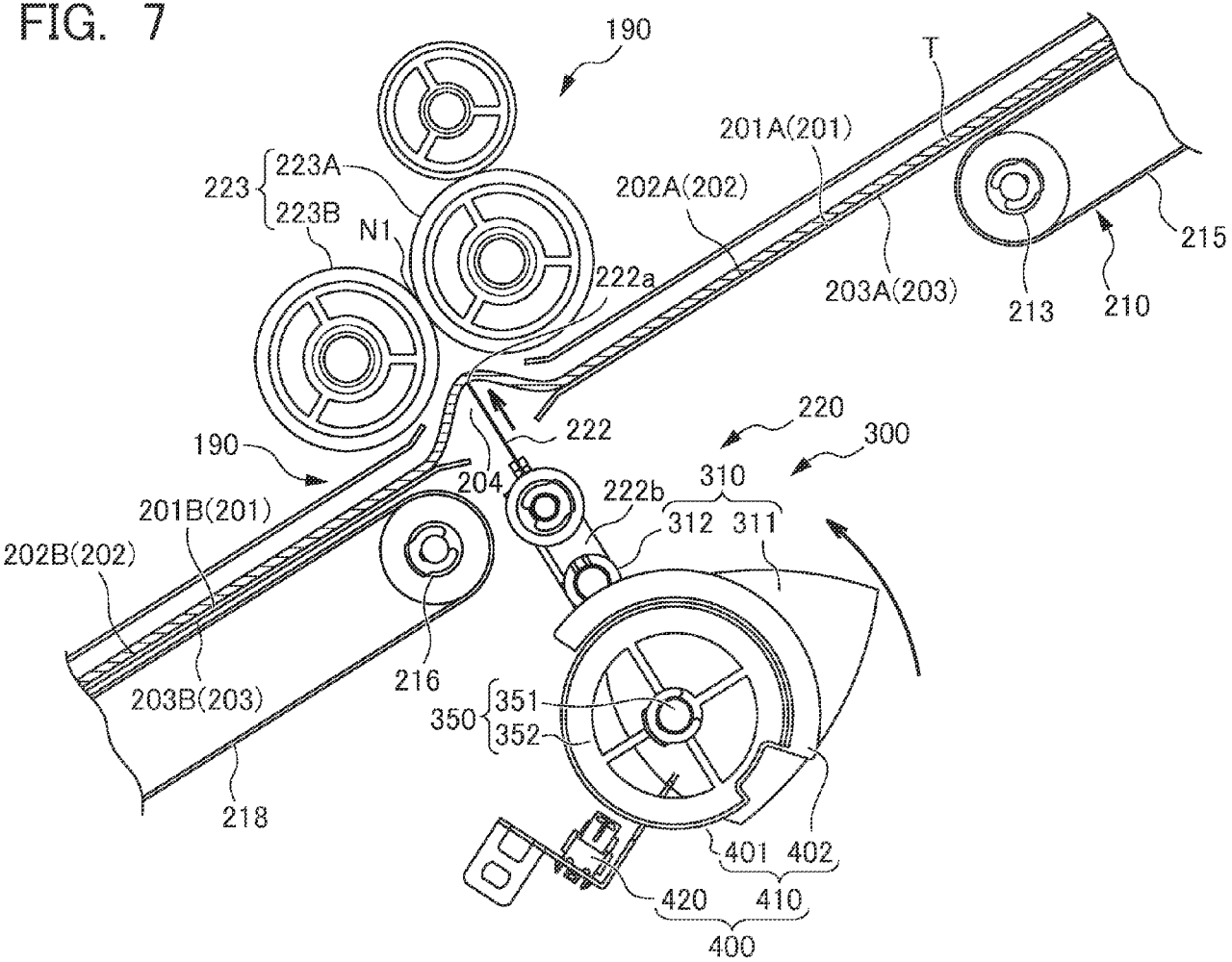
FIG. 7 is a diagram explaining a state in which the blade is moving from the initial position to a protruded position.
Figure 8:
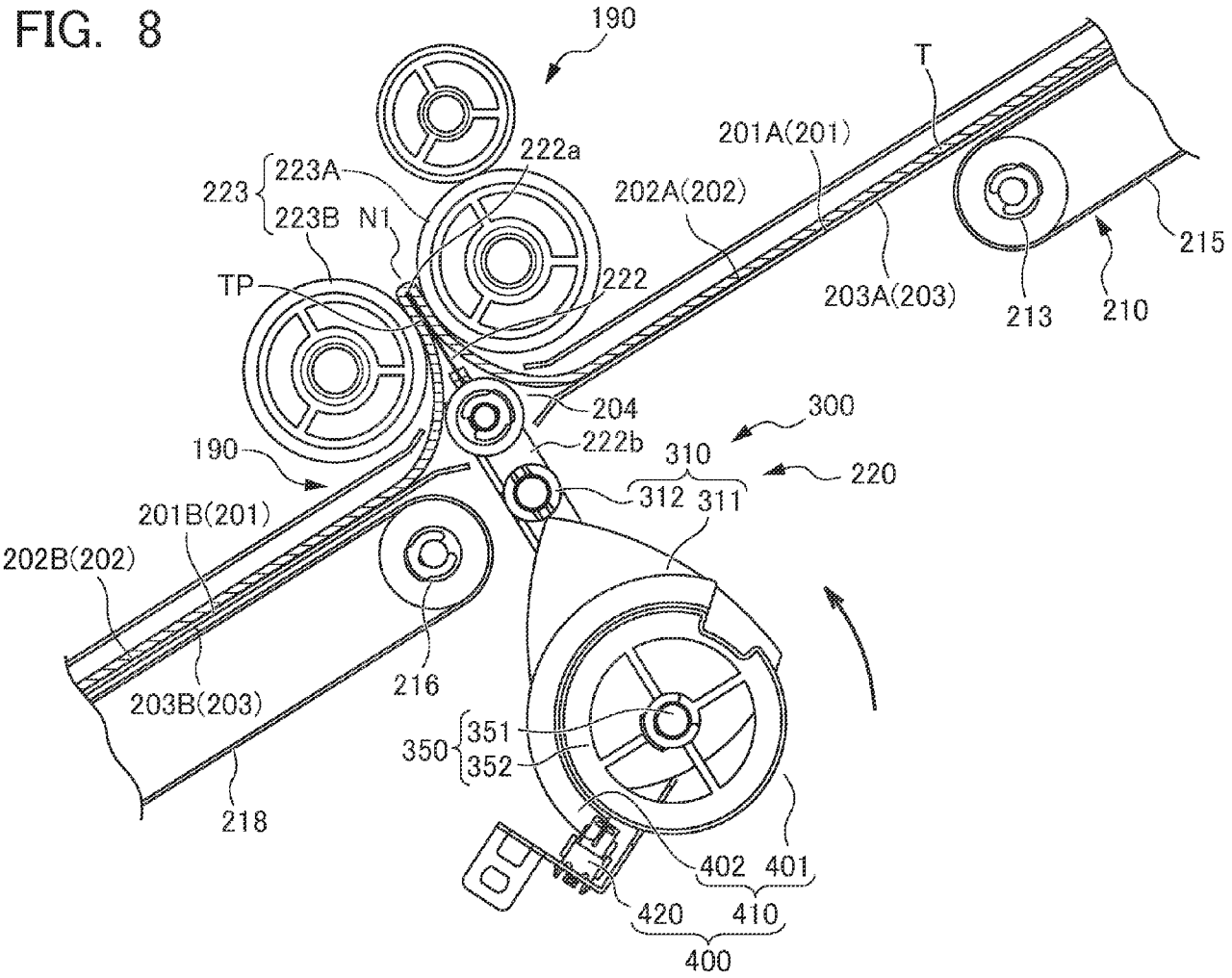
FIG. 8 is a diagram explaining a state in which the blade is positioned at the protruded position.
Figure 9:
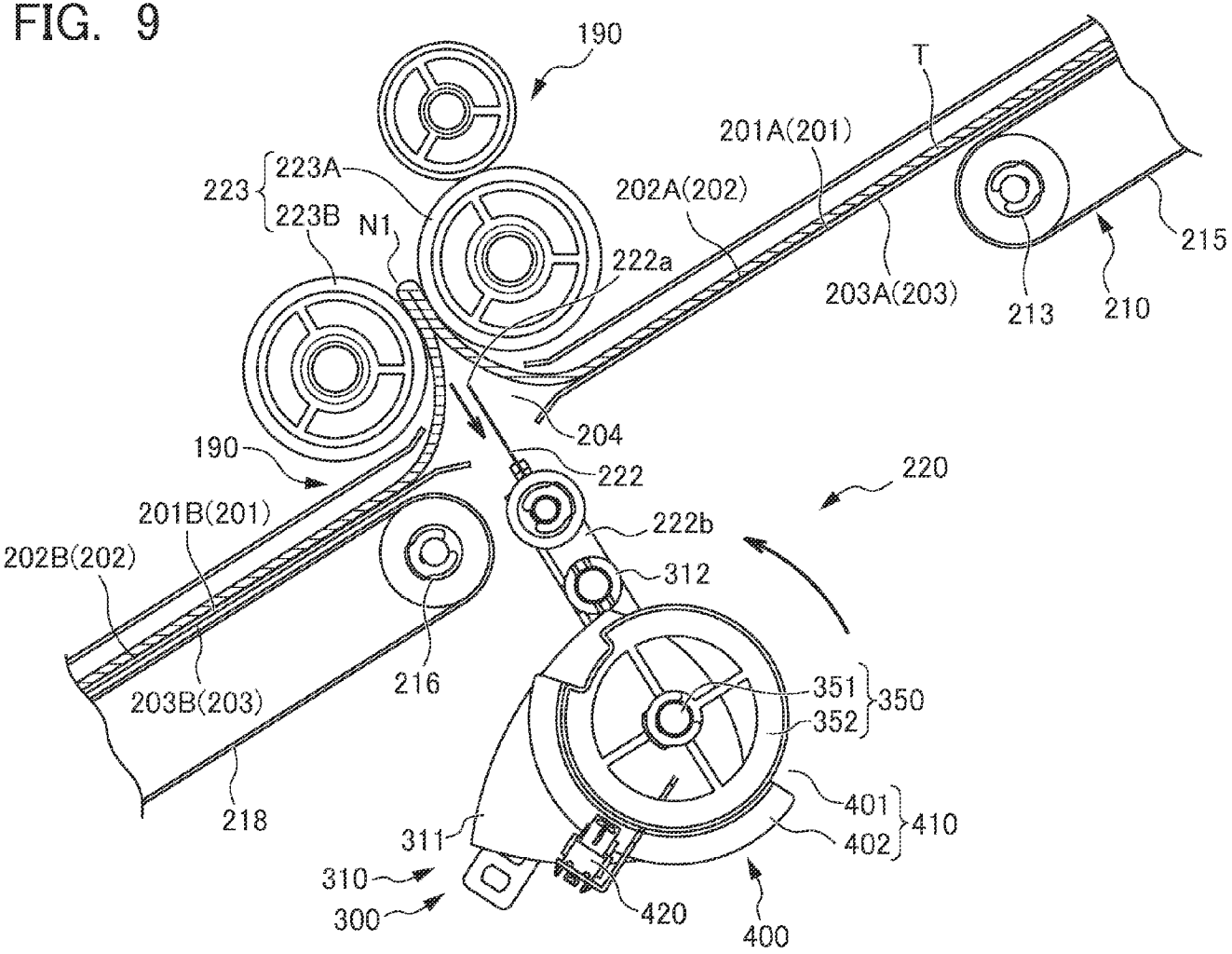
FIG. 9 is a diagram explaining a state in which the blade has been moved from the protruded position to the initial position side.
Figure 10:
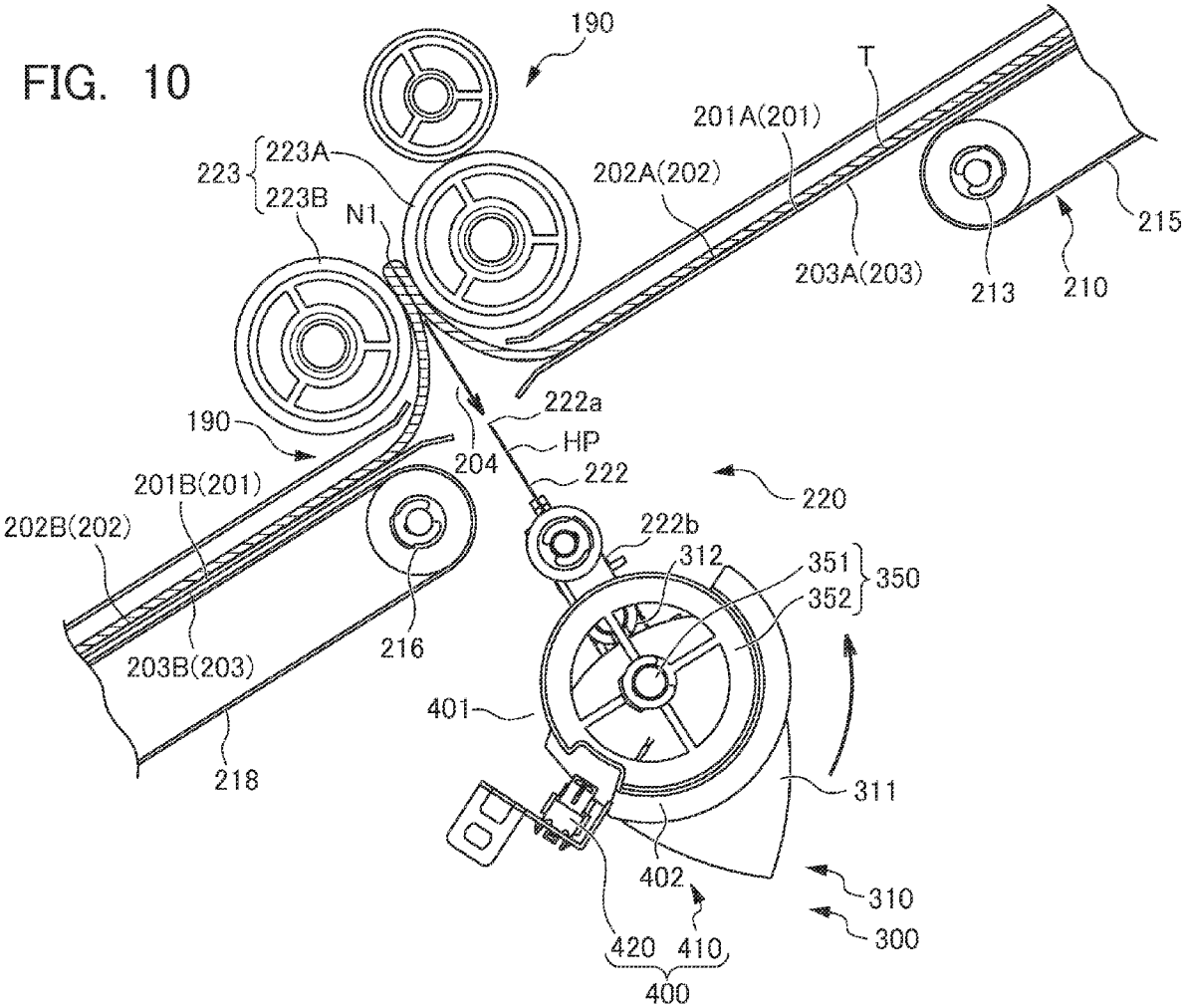
FIG. 10 is a diagram explaining a state in which the blade has been brought back to the initial position.
Figure 11:
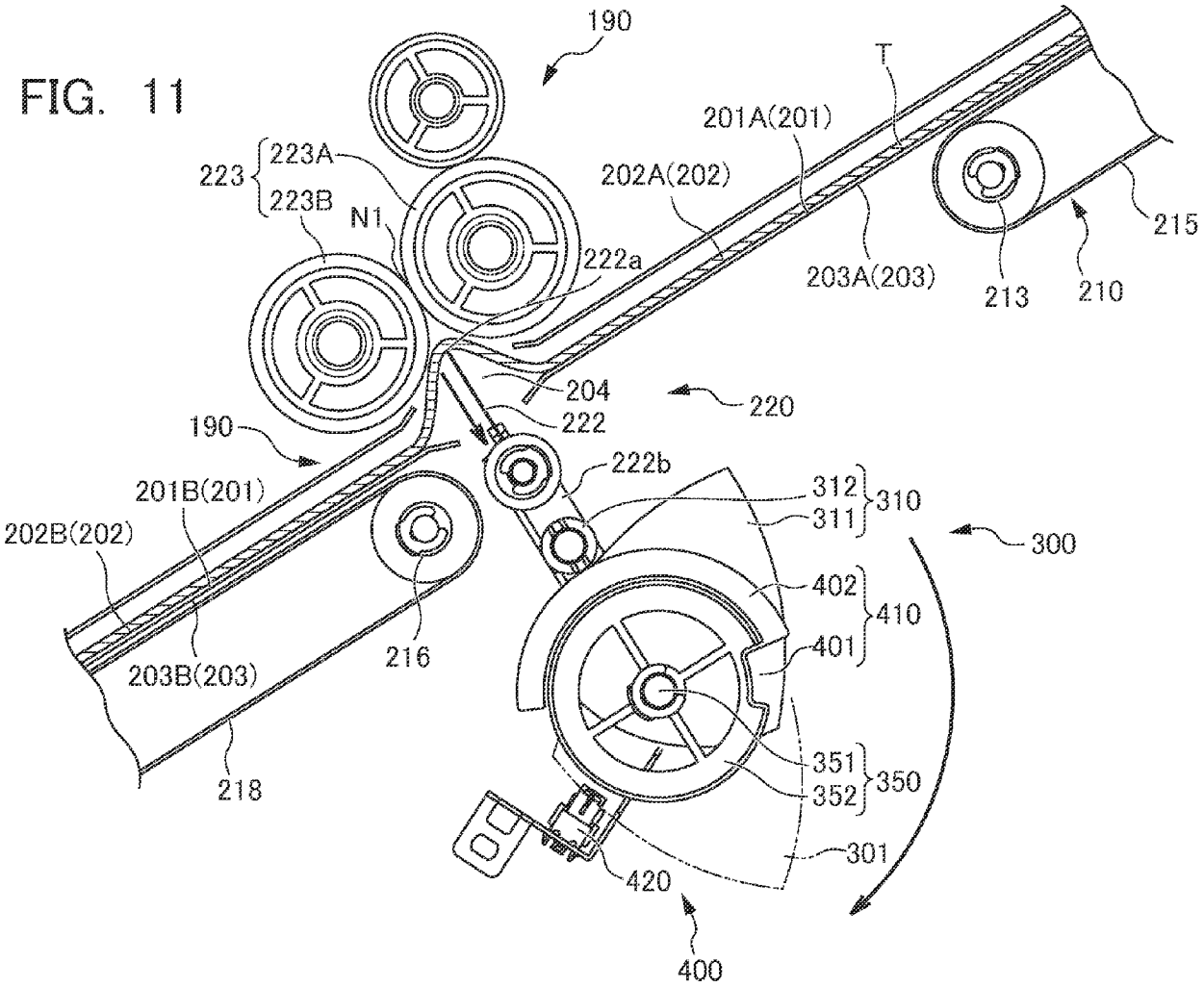
FIG. 11 is a diagram explaining a state in which the blade has been further moved from the position of FIG. 7 to the protruded position side.
Figure 12:
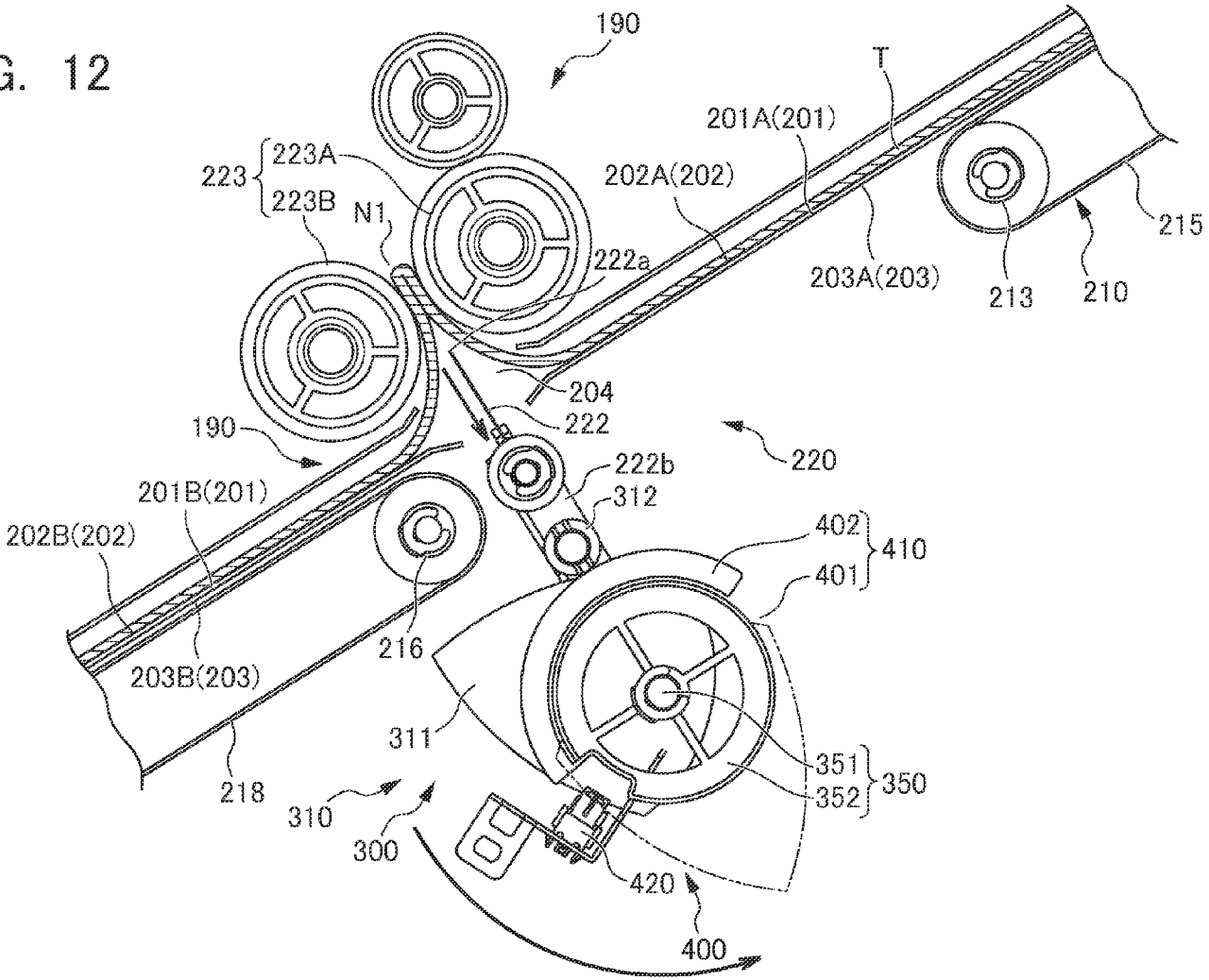
FIG. 12 is a diagram explaining a state in which the blade has been further moved from the position of FIG. 8 to the initial position side.

FIG. 5 is a flow chart explaining an operation in the folding processing unit in the copy machine of the first embodiment. FIG. 6 is a diagram explaining a state in which the blade is positioned at an initial position. FIG. 7 is a diagram explaining a state in which the blade is moving from the initial position to the protruded position. FIG. 8 is a diagram explaining a state in which the blade is positioned at the protruded position. FIG. 9 is a diagram explaining a state in which the blade has been moved from the protruded position to the initial position side. FIG. 10 is a diagram explaining a state in which the blade has been brought back to the initial position. FIG. 11 is a diagram explaining a state in which the blade has been further moved from the position of FIG. 7 to the protruded position side. FIG. 12 is a diagram explaining a state in which the blade has been further moved from the position of FIG. 8 to the initial position side.

First, normal folding processing (operation) is described with reference to FIGS. 6 to 10.

As shown in FIG. 6, the paper T is introduced by the conveying path 110*d* into the folding processing unit 190. The paper T having been introduced into the folding processing unit 190 is placed on the upstream sheet placement face 202A of the upstream sheet placement member 201A and the downstream sheet placement face 202B of the downstream sheet placement member 201B. Furthermore, the position of the paper T is aligned in the alignment portion 210.

In this state, the blade member 222 stands by while being positioned at the initial position HP. More specifically, the blade member 222 stands by while being positioned below (on the opposite face 203 side of) the upstream sheet placement face 202A of the upstream sheet placement member 201A and the downstream sheet placement face 202B of the downstream sheet placement member 201B.

Subsequently, the rotational drive control unit 370 controls the rotational driving unit 360 to rotationally drive in the positive rotational direction.

As a result, as shown in FIG. 7, as the rotating member 350 positively rotates, the cam member 311 connected to the rotating member 350 positively rotates.

In addition, the tip end part 222*a* of the blade member 222 moves via the contacting member 312, and penetrates through the through portion 204, to the sheet placement face 202 side. The blade member 222 moves from the initial position HP toward the protruded position TP.

In addition, the blade member 222 is brought into contact with the paper T and moves the paper T toward the pair of folding rollers 223 while folding the paper T.

Subsequently, the rotational drive control unit 370 controls the rotational driving unit 360 to continue the rotational drive in the positive rotational direction.

As a result, as shown in FIG. 8, the rotating member 350 further positively rotates and the cam member 311 connected to the rotating member 350 further positively rotates.

In addition, as a result, the tip end part 222*a* of the blade member 222 further moves via the contacting member 312 to move to (position at) the protruded position TP.

In addition, as a result, the blade member 222 tucks the paper T thus folded into the first nip N1 provided by the pair of folding rollers 223.

Subsequently, the rotational drive control unit 370 controls the rotational driving unit 360 to continue the rotational drive in the positive rotational direction.

As a result, as shown in FIG. 9, the rotating member 350 further positively rotates and the cam member 311 connected to the rotating member 350 further positively rotates.

In addition, as a result, in association with movement of the contacting member 312 that is brought into contact with an external edge of the cam member 311 by the spring member 380, the tip end part 222*a* of the blade member 222 moves from the protruded position TP toward the initial position HP.

Furthermore, as a result, the blade member 222 is spaced apart from the paper T having been folded.

Subsequently, the rotational drive control unit 370 controls the rotational driving unit 360 to continue the rotational drive in the positive rotational direction.

As a result, as shown in FIG. 10, the rotating member 350 further positively rotates and the cam member 311 connected to the rotating member 350 further positively rotates.

In addition, as a result, in association with movement of the contacting member 312 that is brought into contact with the external edge of the cam member 311 by the spring member 380, the tip end part 222*a* of the blade member 222 further moves toward (positions at) the initial position HP.

Furthermore, in a case in which the blade member 222 is detected to position at the initial position HP based on the position information from the detecting sensor 420, the rotational drive control unit 370 controls the rotational driving unit 360 to stop the rotational drive.

The pair of folding rollers 223 receives the paper T being tucked by the blade member 222 and feeds the paper T to the conveying path 110*e* while making a fold.

The paper T after the folding processing is discharged from the second discharging unit 230.

And then, the post processing device 100 (the folding processing unit 190) stops the folding processing (operation).

Next, based on FIG. 5, the folding processing (operation) in a case of abnormality will be described with reference to FIGS. 11 and 12.

In Step ST11, the rotational drive control unit 370 determines whether a notification of reception of a predetermined signal from the signal receiving unit 365 is received.

In a case in which the notification is not received (Step ST11, NO), the rotational drive control unit 370 returns the processing to a state before Step ST11.

In a case in which the notification is received (Step ST11, YES), the rotational drive control unit 370 advances the processing to Step ST12.

Subsequently, in Step ST12, the rotational drive control unit 370 determines whether the blade member 222 is in the state of moving from the initial position HP to the protruded position TP based on the rotational position information received from the detecting sensor 320.

In a case in which the blade member 222 is determined to be in the state of moving from the initial position HP to the protruded position TP, as shown in FIG. 11 (Step ST12, YES), the rotational drive control unit 370 advances the processing to Step ST13.

In a case in which the blade member 222 is determined not to be in the state of moving from the initial position HP to the protruded position TP, for example as shown in FIG. 12 (in a state in which the blade member 22 is determined to be in a state of moving from the protruded position TP to the initial position HP) (Step S12, NO), the rotational drive control unit 370 advances the processing to Step ST14.

Subsequently, in Step ST13, the rotational drive control unit 370 controls the rotational driving unit 360 to drive in a negative rotation in a reversed rotational direction (to reverse the rotational direction).

For example, the blade member 222 moves from a position shown in FIG. 11 to the initial position HP shown in FIG. 6 via the position shown in FIG. 7.

As a result, the blade member 222 returns to the initial position HP without being positioned at the protruded position TP, where a higher load is applied. The blade member 222 can thus return to the initial position HP in a low load state.

In addition, in Step ST14, the rotational drive control unit 370 controls the rotational driving unit 360 to maintain the positive rotation.

For example, the blade member 222 moves from the position shown in FIG. 12 to the initial position HP shown in FIG. 10 via the position shown in FIG. 9.

The blade member 222 has already overpassed the protruded position TP where a higher load is applied. As a result, in a state in which the rotational driving unit 360 is maintained in the positive rotation, the blade member 222 can thus return to the initial position HP in a low load state.

And then, in Step ST15, the rotational drive control unit 370 determines whether the blade member 222 is positioned at the initial position HP based on the rotational position information.

In a case in which the blade member 222 is not determined to be positioned at the initial position HP (Step ST15, NO), the rotational drive control unit 370 returns the processing to a state before Step ST15.

Furthermore, in a case in which the blade member 222 is determined to be positioned at the initial position HP (Step ST15, YES), the rotational drive control unit 370 controls the rotational driving unit 360 to stop the drive.

And then, the post processing device 100 (the folding processing unit 190) stops the folding processing (operation).

According to the first embodiment, a post processing device that suppresses damage of the folding member and that can reduce an operator's burden in a case of failure can be provided.

In addition, according to the first embodiment, an image forming apparatus including the post processing device can be provided.

In addition, according to the first embodiment, the post processing device 100 (copy machine 1) includes: the driving mechanism that makes the blade member 222 reciprocate between the initial position HP and the protruded position TP, including the rotational driving unit 360 that can output a rotational driving force and can reverse the direction of rotational drive, the rotating member 350 that is directly or indirectly connected to the rotational driving unit 360 and is rotated by the rotational driving force from the rotational driving unit 360, and the cam mechanism 310 that is connected to the rotating member 350 and converts a rotational motion of the rotating member 350 into a reciprocating motion; the rotational position detecting mechanism 400 that detects a rotational position of the rotating member 350 and outputs rotational position information; the signal receiving unit 365 that receives a predetermined signal; and the rotational drive control unit 370 that receives the rotational position information from the rotational position detecting mechanism 400, and when the signal receiving unit 365 receives the predetermined signal, determines whether the blade member 222 is in a state of moving from the initial position HP to the protruded position TP or the blade member 222 is in a state of moving from the protruded position TP to the initial position HP based on the rotational position information, and, in a case in which the blade member 222 is determined to be in the state of moving from the initial position HP to the protruded position TP, controls the rotational driving unit 360 to reverse the direction of rotational drive, and in a case in which the blade member 222 is determined to be in the state of moving from the protruded position TP to the initial position HP, controls the rotational driving unit 360 to maintain the direction of rotational drive.

As a result, the post processing device 100 (the copy machine 1) can return the blade member 222 to the initial position HP in a low load state. As a result, the post processing device 100 (the copy machine 1) can suppress (further) damage to the blade member 222. In addition, the post processing device 100 (the copy machine 1) can reduce the user's burden of operation.

Furthermore, according to the first embodiment, the rotational position detecting mechanism 400 includes the detected portion 410 that is disposed on the rotating member 350, and the detecting sensor 420 that is disposed at a position corresponding to the detected portion 410 and detects position information relating to the detected portion 410.

As a result, the post processing device 100 (the copy machine 1) can determine the position of the blade member 222 based on the detected information. As a result, the post processing device 100 (the copy machine 1) is configured in a simple configuration to be capable of determining the position of the blade member 222.

Furthermore, according to the first embodiment, the cam mechanism 310 converts the rotational motion into the reciprocating motion in such a way that, as the rotating member 350 makes one rotation, the blade member 222 makes one reciprocation. As a result, the post processing device 100 (the copy machine 1) can correctly determine the position of the blade member 222 as well as the state of moving of the blade member 222, by obtaining the rotational position information of the rotating member 350.

Furthermore, according to the first embodiment, in a case in which the blade member 222 is determined to be positioned at the initial position HP based on the rotational position information, the rotational drive control unit 370 controls the rotational driving unit 360 to stop the rotational drive. As a result, the post processing device 100 (the copy machine 1) can infallibly position the blade member 222 at the initial position HP in a case of abnormality. In addition, the post processing device 100 (the copy machine 1) can reduce the user's burden of operation.

Second Embodiment

Figure 13:
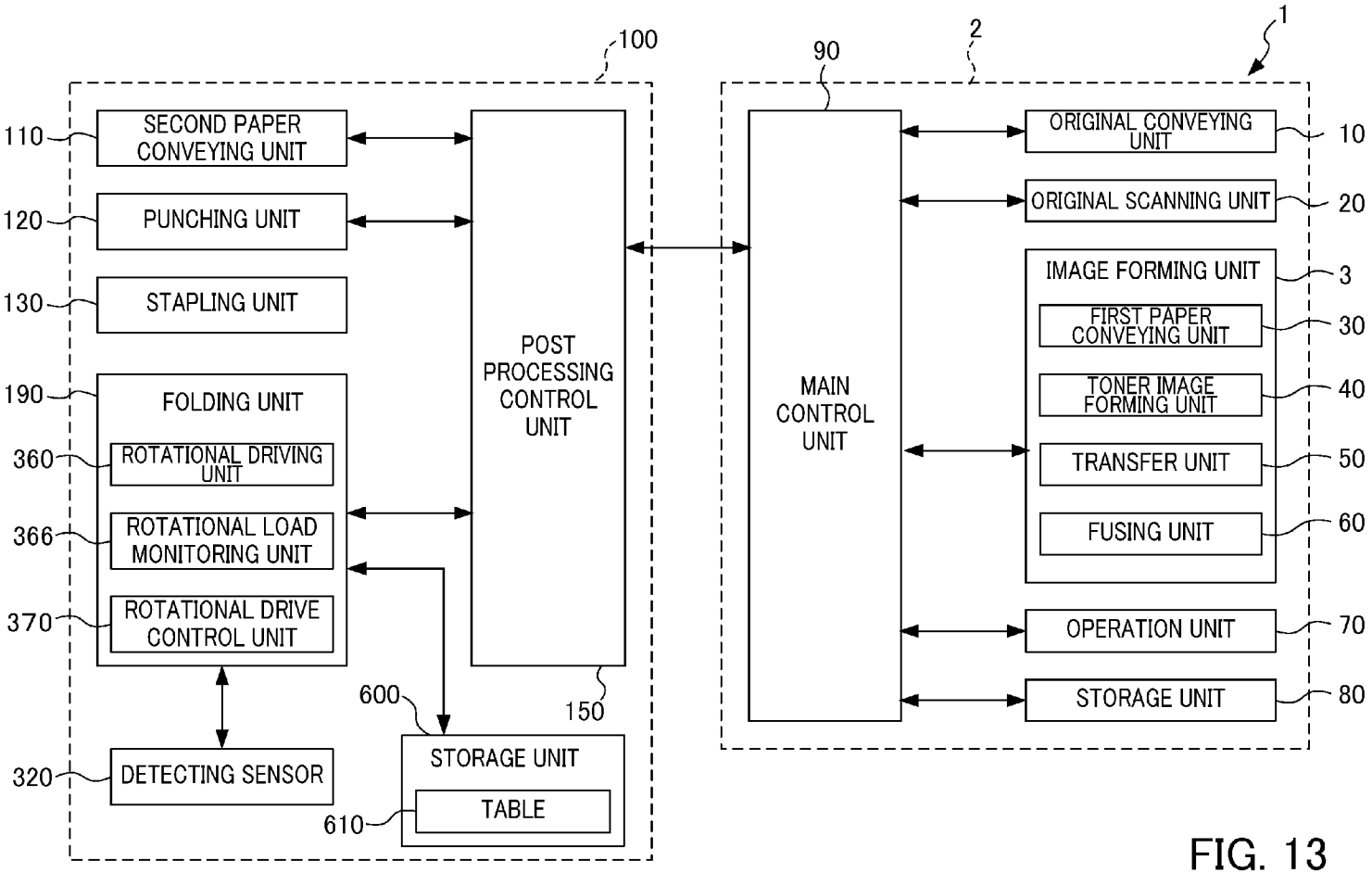
FIG. 13 is a block diagram showing a functional configuration in a copy machine (post processing device) of a second embodiment.
Figure 14:
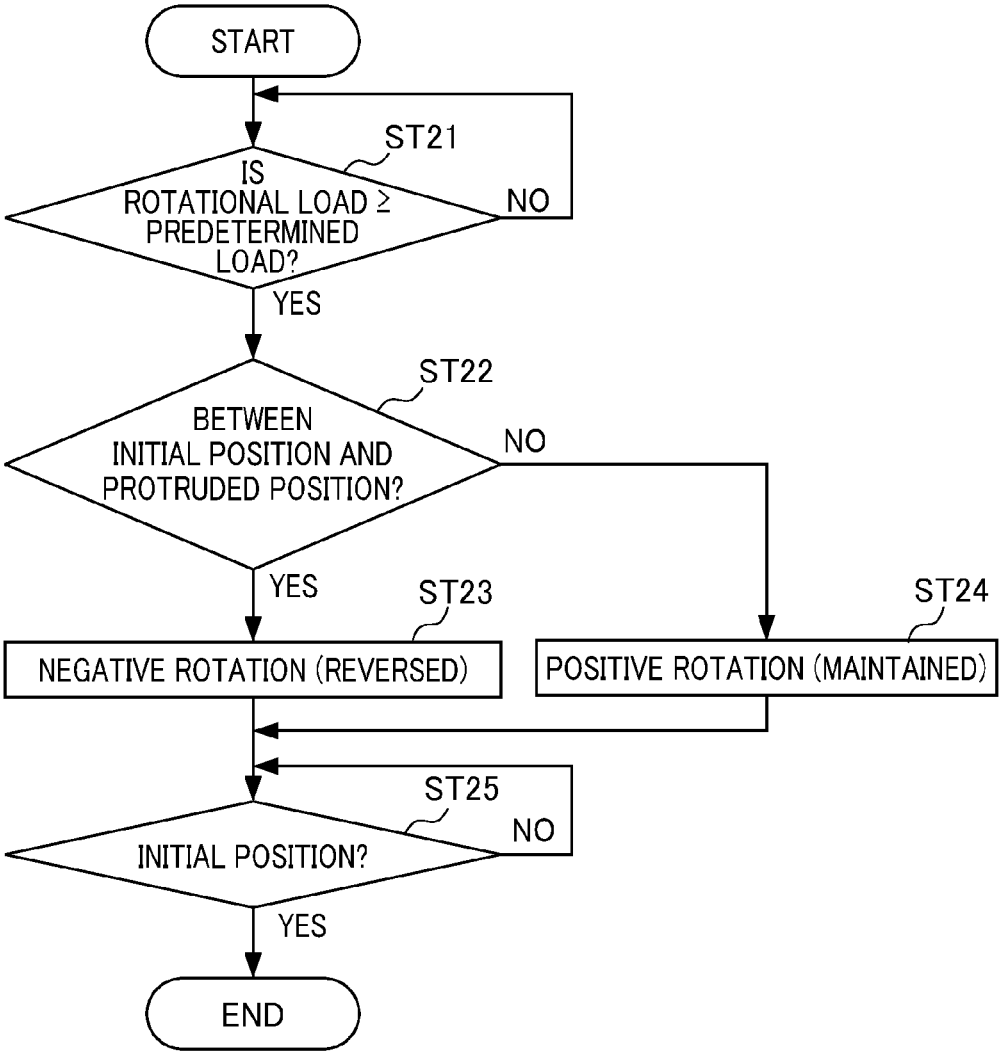
FIG. 14 is a flow chart explaining an operation in the folding processing unit in the copy machine of the second embodiment.

Next, a second embodiment of the present invention will be described in detail with reference to FIGS. 13 and 14. FIG. 13 is a block diagram showing a functional configuration in a copy machine (post processing device) of the second embodiment. FIG. 14 is a flow chart explaining an operation in the folding processing unit in the copy machine of the second embodiment.

In the second embodiment, description will center on the points of difference from the first embodiment. Description in relation to the first embodiment is suitably applied and employed in relation to points that are not described in particular detail in relation to the second embodiment.

The second embodiment of the present invention is different from the first embodiment mainly in that a rotational load monitoring unit 366 is provided in place of the signal receiving unit 365 provided in the first embodiment.

In the second embodiment, the rotational driving unit 360 can output a rotational driving force as in the first embodiment. The rotational driving unit 360 is configured to be capable of reversing a direction of the rotational drive. The rotational driving unit 360 is configured to include, for example, a motor.

The rotational driving unit 360 is configured to be capable of reversing a rotational direction between a positive rotational direction, which is a normal rotational direction, and a negative rotational direction, which is a rotational direction opposite to the positive rotational direction.

Here, as a motor constituting the rotational driving unit 360, various motors such as a stepping motor, a brushed motor, a brushless motor can be used. In addition, in the second embodiment, as a detection method of rotational load in the rotational load monitoring unit 366, a detection method suitable for characteristics of each motor can be employed. The rotational load monitoring unit 366 will be described later.

In the second embodiment, the rotational driving unit 360 is controlled by the rotational drive control unit 370 (described later, refer to FIG. 13) as in the first embodiment. For example, in the second embodiment, in a case in which the rotational load monitoring unit 366, which is described later, determines that the rotational load in the rotational driving unit 360 is at least a predetermined load and the rotational drive control unit 370 (drive control unit) determines that the blade member 222 is in a state of moving from the initial position HP to the protruded position TP, the rotational driving unit 360 is controlled by the rotational drive control unit 370 to reverse the direction of rotational drive.

Alternatively, in a case in which the rotational load monitoring unit 366, which is described later, determines that the rotational load in the rotational driving unit 360 is at least a predetermined load and the rotational drive control unit 370 (drive control unit) receives a predetermined signal and determines that the blade member 222 is in a state of moving from the protruded position TP to the initial position HP, the rotational driving unit 360 is controlled by the rotational drive control unit 370 to maintain the direction of rotational drive.

In the second embodiment, the folding unit 190 includes the rotational driving unit 360, the rotational load monitoring unit 366, and the rotational drive control unit 370. The rotational driving unit 360 is the same as in the first embodiment.

The rotational load monitoring unit 366 detects a rotational load in the rotational driving unit 360 and determines whether the rotational load is at least a predetermined load. In addition, in a case in which the rotational load in the rotational driving unit 360 is determined to be at least the predetermined load, the rotational load monitoring unit 366 notifies the rotational drive control unit 370 of the determination.

Here, the rotational load monitoring unit 366 can detect the rotational load based on a predetermined parameter.

For example, the rotational load monitoring unit 366 detects the rotational load based on a current value, rotational speed, rotational cycle, back electromotive force and the like as parameters.

For example, in a case in which the rotational driving unit 360 is a brushed motor or a brushless motor, a current value can be used as a parameter.

And then, when the current value shows a predetermined change, for example the current value is at least a predetermined value, the rotational load monitoring unit 366 determines that the rotational load of the rotational driving unit 360 is at least the predetermined load.

In this case, the rotational load monitoring unit 366 can be configured to include a resistive element mounted on a substrate (not illustrated) and a current detecting unit.

Alternatively, in a case in which the rotational driving unit 360 is, for example, a stepping motor, a brushed motor, a brushless motor and the like, the rotational speed of the rotational driving unit (motor) can be used as a parameter.

And then, when the rotational speed shows a predetermined change, for example the rotational speed is no greater than a predetermined speed, the rotational load monitoring unit 366 determines that the rotational load of the rotational driving unit 360 is at least the predetermined load.

In this case, the rotational load monitoring unit 366 can be configured to include, for example, a plurality of through holes provided at predetermined intervals on the detected portion 410 and a rotational speed calculating unit that calculates the rotational speed based on a detection result from the detecting sensor 320.

Yet alternatively, in a case in which the rotational driving unit 360 is, for example, a stepping motor, a brushed motor, a brushless motor and the like, the rotational cycle can be used as a parameter.

And then, when the rotational cycle shows a predetermined change, for example the rotational cycle is at least a predetermined cycle, the rotational load monitoring unit 366 determines that the rotational load of the rotational driving unit 360 is at least the predetermined load.

In this case, the rotational load monitoring unit 366 can be configured to include, for example, one or a plurality of through holes provided on the detected portion 410 and a rotational cycle calculating unit that calculates the rotational cycle based on a detection result from the detecting sensor 320. In addition, in a case in which the rotational driving unit 360 is configured to include a brushless motor, the rotational load monitoring unit 366 can be configured to include a hall element mounted on the substrate and a rotational cycle calculating unit that calculate the rotational cycle based on a signal that is output from the hall element.

The rotational drive control unit 370 controls the rotational driving unit 360.

The rotational drive control unit 370 receives the rotational position information from the rotational position detecting mechanism 400 (detecting sensor 420).

In addition, in the second embodiment, the rotational drive control unit 370 receives the abovementioned notification from the rotational load monitoring unit 366.

In the second embodiment, the rotational drive control unit 370, when the rotational load monitoring unit 366 detects the rotational load of the rotational driving unit 360 (when the notification from the rotational load monitoring unit 366 is received), determines whether the blade member 222 is in a state of moving from the initial position HP to the protruded position TP or the blade member 22 is in a state of moving from the protruded position TP to the initial position HP based on the rotational position information thus received.

Next, in the second embodiment, based on FIG. 14, the folding processing (operation) in a case of abnormality will be described with reference to FIGS. 11 and 12.

A part of the operation in the second embodiment is different from the operation in the first embodiment and the rest is the same. More specifically, the operation in Step ST21 (control flow; refer to FIG. 14) of the second embodiment is different from Step ST11 (control flow; refer to FIG. 5) of the first embodiment.

In the second embodiment, in Step ST21, the rotational drive control unit 370 determines whether a notification of the rotational load being at least the predetermined load if received from the rotational load monitoring unit 366.

In a case in which the notification is not received (Step ST21, NO), the rotational drive control unit 370 returns the processing to a state before Step ST21.

In a case in which the notification is received (Step ST21, YES), the rotational drive control unit 370 advances the processing to the Step ST22.

The operations from Step ST22 to Step ST25 in the second embodiment are the same as Step ST12 to Step ST15 in the first embodiment and therefore descriptions in the first embodiment are employed and descriptions for the second embodiment are omitted.

In addition, according to the second embodiment, the post processing device 100 (copy machine 1) includes: the driving mechanism that makes the blade member 222 reciprocate between the initial position HP and the protruded position TP, including the rotational driving unit 360 that can output a rotational driving force and can reverse the direction of rotational drive, the rotating member 350 that is directly or indirectly connected to the rotational driving unit 360 and is rotated by the rotational driving force from the rotational driving unit 360, and the cam mechanism 310 that is connected to the rotating member 350 and converts a rotational motion of the rotating member 350 into a reciprocating motion; the rotational position detecting mechanism 400 that detects a rotational position of the rotating member 350 and outputs rotational position information; the rotational load monitoring unit 366 that detects a rotational load generated in the rotational driving unit 360 and determines whether the rotational load is at least a predetermined load; and the rotational drive control unit 370 that receives the rotational position information from the rotational position detecting mechanism 400, and when the rotational load monitoring unit 366 determines that the rotational load is at least the predetermined load, determines whether the blade member 222 is in a state of moving from the initial position HP to the protruded position TP or the blade member 222 is in a state of moving from the protruded position TP to the initial position HP based on the rotational position information, and, in a case in which the blade member 222 is determined to be in the state of moving from the initial position HP to the protruded position TP, controls the rotational driving unit 360 to reverse the direction of rotational drive, and in a case in which the blade member 222 is determined to be in the state of moving from the protruded position TP to the initial position HP, controls the rotational driving unit 360 to maintain the direction of rotational drive.

As a result, according to the second embodiment, the post processing device 100 (the copy machine 1) can return the blade member 222 to the initial position HP in a low load state as in the first embodiment. As a result, the post processing device 100 (the copy machine 1) can suppress (further) damage to the blade member 222. In addition, the post processing device 100 (the copy machine 1) can reduce the user's burden of operation.

Furthermore, according to the second embodiment, the rotational position detecting mechanism 400 includes the detected portion 410 that is disposed on the rotating member 350, and the detecting sensor 420 that is disposed at a position corresponding to the detected portion 410 and detects detection information relating to the detected portion 410.

As a result, according to the second embodiment, the post processing device 100 (the copy machine 1) can determine the position of the blade member 222 based on the detected information as in the first embodiment. As a result, the post processing device 100 (the copy machine 1) is configured in a simple configuration to be capable of determining the position of the blade member 222.

Although the preferred embodiments of the post processing device 100 (the copy machine 1) according to the present invention have been described above, the post processing device 100 (the copy machine 1) according to the present invention is not limited to such embodiments, and may be executed in various modes.

In the above embodiments, the driving mechanism is configured to include the cam mechanism as the converting unit. However, the present invention is not limited thereto. The driving mechanism can be configured to include, for example, a crank mechanism.

Figure 15A:
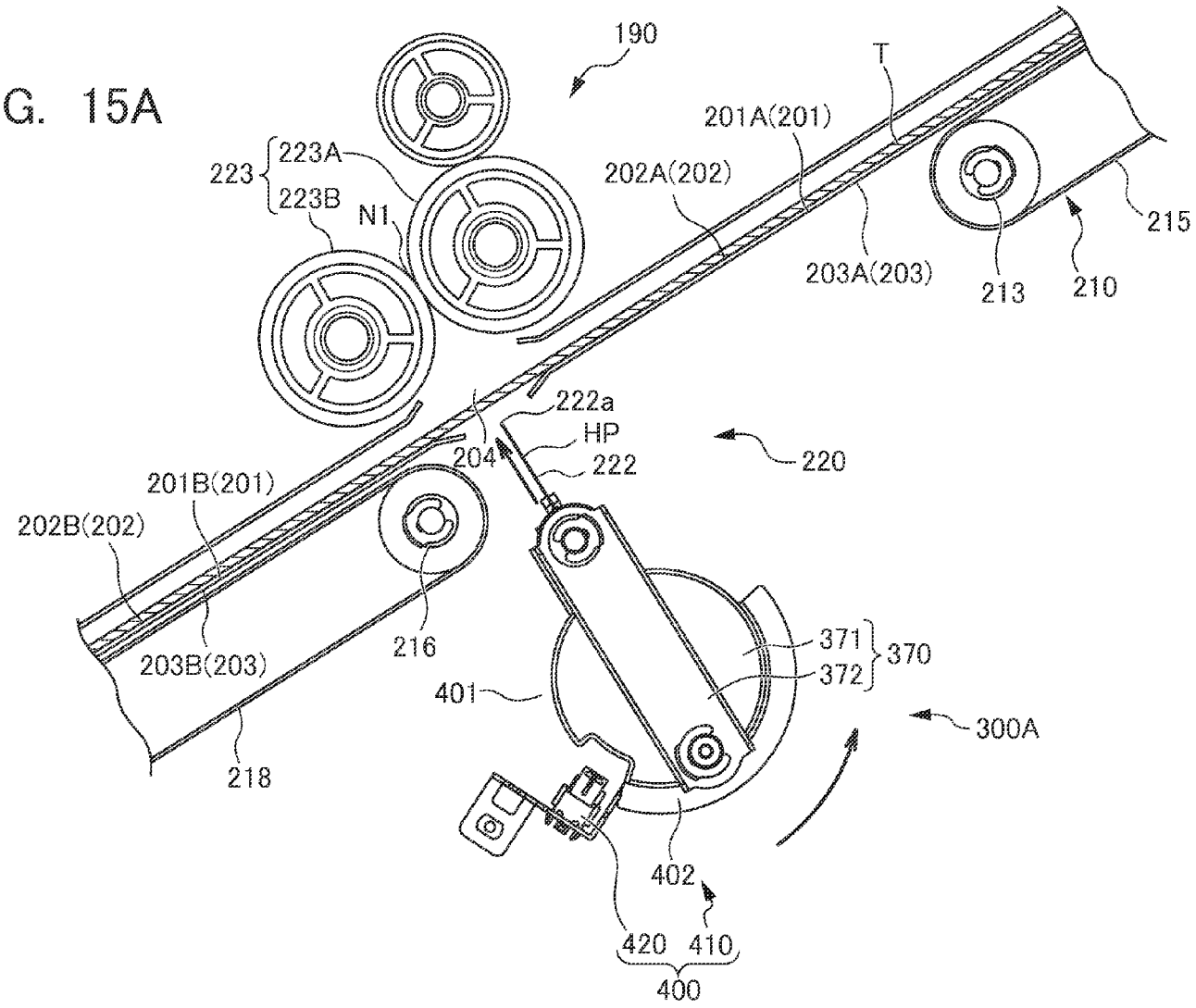
FIG. 15A is a diagram explaining a crank mechanism that composes the folding processing unit in another embodiment.
Figure 15B:
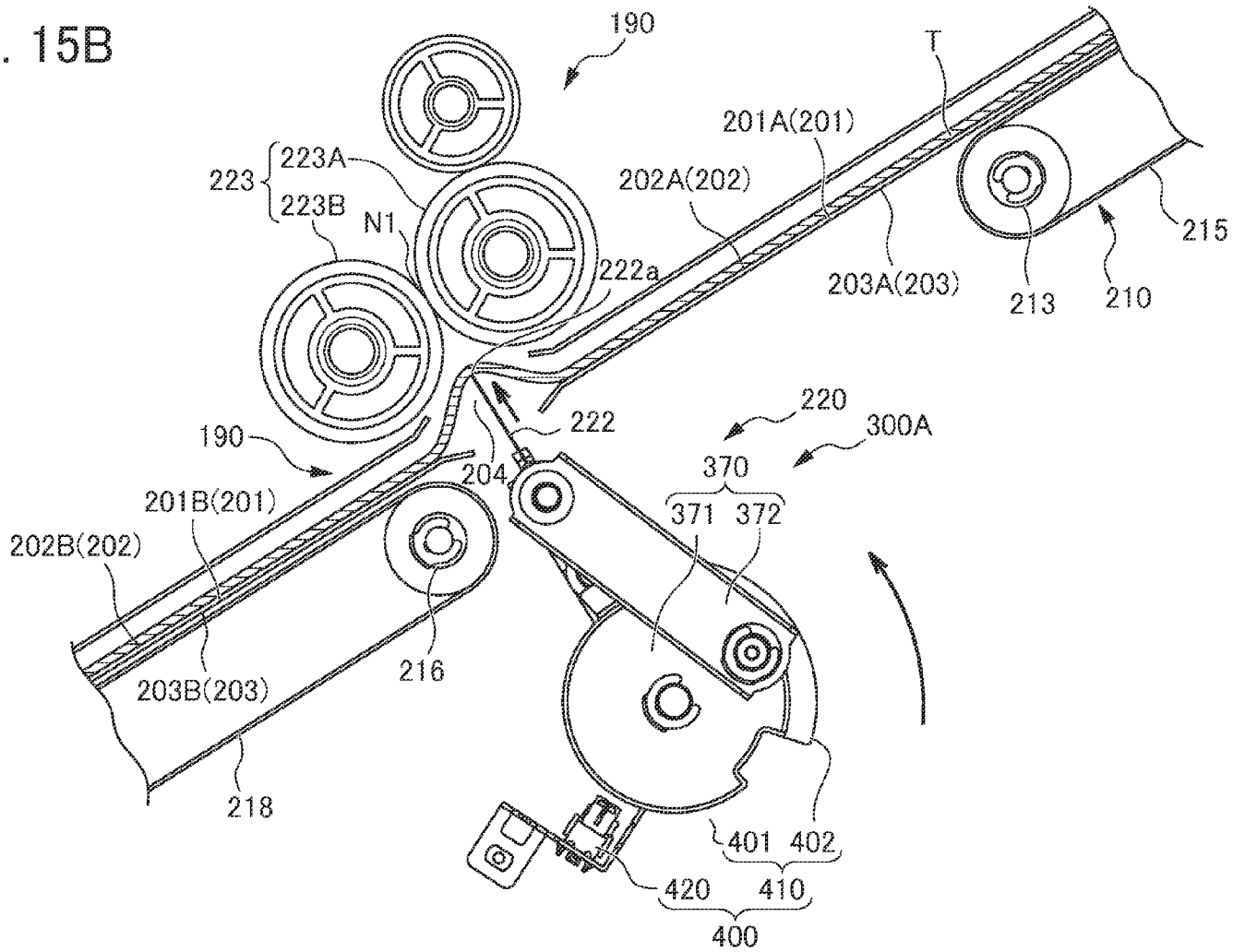
FIG. 15B is a diagram explaining an operation of the crank mechanism.
Figure 15C:
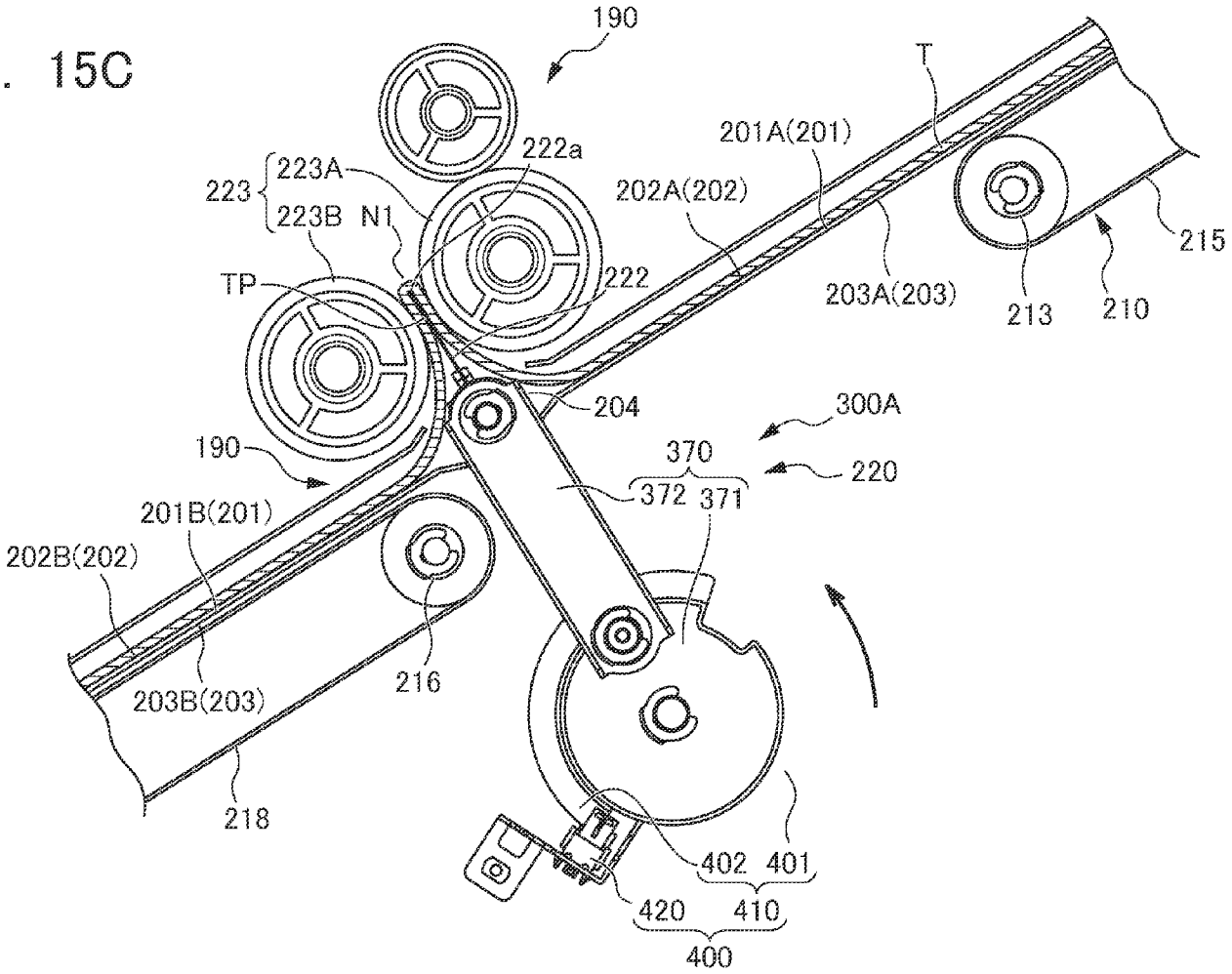
FIG. 15C is a diagram explaining an operation of the crank mechanism.
Figure 15D:
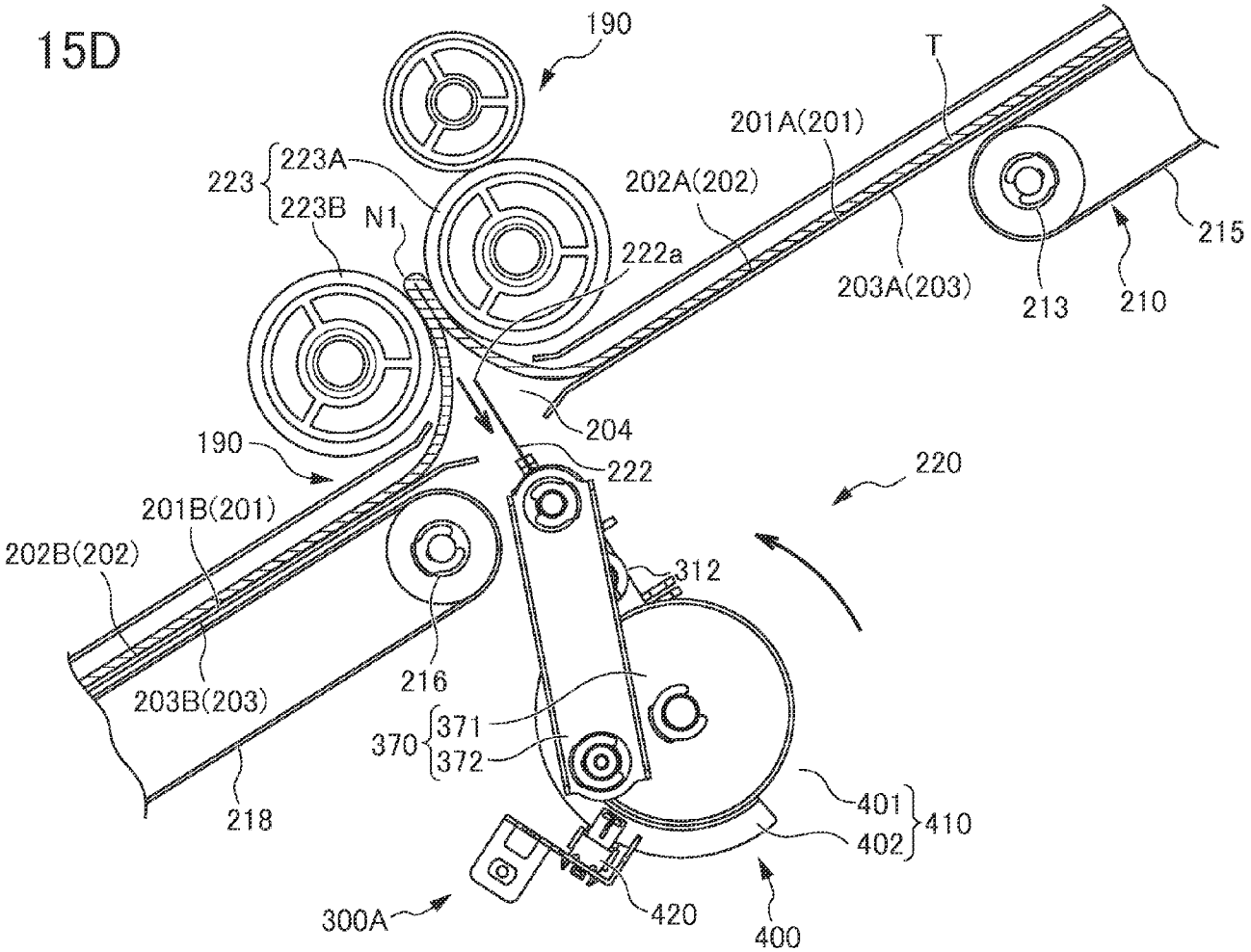
FIG. 15D is a diagram explaining an operation of the crank mechanism.

The crank mechanism 310A is described with reference to FIGS. 15A to 15D. FIG. 15A is a diagram explaining a crank mechanism that composes the folding processing unit in another embodiment. FIG. 15B is a diagram explaining an operation of the crank mechanism. FIG. 15C is a diagram explaining an operation of the crank mechanism. FIG. 15D is a diagram explaining an operation of the crank mechanism.

As shown in FIG. 15A, the driving mechanism 300A includes a crank mechanism 370.

The crank mechanism is a driving mechanism that converts a rotational motion of a crank portion 371 into a reciprocating motion via a rod portion 372. The crank mechanism 370 converts the rotational motion into the reciprocating motion in such a way that, as the crank portion 371 makes one rotation, the blade member 222 makes one reciprocation.

The crank mechanism 370 includes the crank portion 371 and the rod portion 372.

The crank portion 371 is rotationally driven by the driving force from the rotational driving unit 360.

A first end portion of the rod portion 372 is connected to a predetermined position on an outer peripheral side of the crank portion 371. The rod portion 372 converts a rotational motion of the crank portion 371 into a reciprocating motion.

The blade member 222 is attached to a second end portion of the rod portion 372.

The crank mechanism 370 makes the blade member 222 reciprocate similarly to the cam mechanism 310.

More specifically, as shown in FIGS. 15B to 15D, the crank portion 371 is rotated by the rotational drive of the rotational driving unit 360. As the crank portion 371 rotates, the rod portion 372 reciprocates. As a result, the blade member 222 connected to the second end side of the rod portion 372 reciprocates between the initial position HP and the protruded position TP.

In addition, in the above described embodiments, the rotational drive control unit 370 is included in the post processing device 100. However, the present invention is not limited thereto and the rotational drive control unit 370 can be included in the copy machine main body 2.

Furthermore, in the above described embodiments, the detecting sensor is a sensor that detects transmitted light. However, the present invention is not limited thereto and the detecting sensor can be a sensor that detects reflected light or a sensor that directly measures a rotational angle.

Moreover, in the above described embodiments, the detected portion is a portion including a light transmitting part and a light shielding part that are continued for a predetermined range. However, the present invention is not limited thereto and the detected portion can be a portion in which light transmitting parts (light shielding parts, reflecting parts) are provided at predetermined intervals, or a portion in which the light transmitting part (light shielding part, reflecting part) which is continued but has a width narrowed (or widened) from place to place is provided.

In addition, in the above described embodiments, the post processing device having the folding unit has been described. However, the present disclosure discloses an invention of a folding device having the folding unit as well.

Furthermore, the copy machine 1 according to the above described embodiments transfers a toner image onto paper T via the intermediate transfer belt 48 (indirect transfer configuration). However there is no limitation to this configuration, and the toner image formed by the photosensitive drum may be directly transferred onto the paper T (direct transfer configuration).

Moreover, the copy machine 1 according to the above described embodiment is configured to print on one side of the paper T. However there is no limitation to this configuration, and double-sided printing of the paper may be executed.

Although the copy machine 1 according to the present embodiment is a color copy machine. However there is no limitation to this configuration, and the copy machine 1 may be a black-and-white copy machine.

The image forming apparatus according to the present invention is not limited to the copy machine 1 described above. In other words, the image forming apparatus according to the present invention may be a multifunction peripheral provided with a copying function, a facsimile function, a printer function, and a scanning function, or may be a facsimile or a printer.

Furthermore, the image formation target material onto which the toner image is fixed by the image forming apparatus according to the present invention is not limited to the paper T, and may be, for example, a film sheet such as an OHP (overhead projector) sheet and the like.

Moreover, the folding device according to the present invention performs the folding processing on a sheet member including a sheet-like image formation target material, a film sheet, and the like.

What is claimed is:

1. A folding device comprising: a conveying path that can convey a sheet member in a predetermined conveying direction;

a placement portion that constitutes a part of the conveying path and has a placement face on which the sheet member can be placed;

a through portion that is formed on the placement portion and formed to be through from the placement face side to an opposite face on an opposite side of the placement face;

a first folding member that is arranged on the opposite face side in the placement portion, to be movable between an initial position where a tip end part thereof is positioned at a predetermined position on the opposite face side and a protruded position where the tip end part penetrates the through portion and is positioned at a predetermined position on the placement face side, the first folding member folding and moving the sheet member by moving from the initial position to the protruded position in a state in which the sheet member is placed thereon;

a second folding member that is arranged on the placement face side of the placement portion, and pinches and receives the sheet member thus folded as well as the first folding member in a state in which the first folding member is positioned at the protruded position;

a driving mechanism having a rotational driving unit that can output a rotational driving force and a rotating member that is rotated by the rotational driving force from the rotational driving unit, the driving mechanism making the first folding member reciprocate between the initial position and the protruded position;

a rotational position detecting mechanism that detects a rotational position of the rotating member and outputs rotational position information;

a signal receiving unit that receives a predetermined signal; and a rotational drive control unit that receives the rotational position information from the rotational position detecting mechanism, wherein: the driving mechanism includes a converting unit that converts a rotational motion of the rotating member into a reciprocating motion;

the rotational driving unit can reverse a direction of rotational drive;

the rotating member is directly or indirectly connected to the rotational driving unit; and the rotational drive control unit, when the signal receiving unit receives the predetermined signal, determines whether the first folding member is in a state of moving from the initial position to the protruded position or the first folding member is in a state of moving from the protruded position to the initial position based on the rotational position information, and, in a case in which the first folding member is determined to be in the state of moving from the initial position to the protruded position, controls the rotational driving unit to reverse the direction of rotational drive, and in a case in which the first folding member is determined to be in the state of moving from the protruded position to the initial position, controls the rotational driving unit to maintain the direction of rotational drive.

2. A post processing device comprising the folding device according to claim 1, wherein the post processing device is configured to be connectable to an image forming apparatus main body.

3. An image forming apparatus comprising the folding device according to claim 1.

4. The folding device according to claim 1, wherein the rotational position detecting mechanism comprises:

a detected portion arranged in the rotating member; and a detecting sensor that is arranged at a position corresponding to the detected portion and detects positional information of the detected portion.

5. The folding device according to claim 1, wherein the converting unit converts the rotational motion into the reciprocating motion in such a way that, as the rotating member makes one rotation, the first folding member makes one reciprocation.

6. The folding device according to claim 1, wherein, in a case in which the first folding member is determined to be positioned at the initial position based on the rotational position information, the rotational drive control unit controls the rotational driving unit to stop the rotational drive.

7. A folding device comprising: a conveying path that can convey a sheet member in a predetermined conveying direction;

a placement portion that constitutes a part of the conveying path and has a placement face on which the sheet member can be placed;

a through portion that is formed on the placement portion and formed to be through from the placement face side to an opposite face on an opposite side of the placement face;

a first folding member that is arranged on the opposite face side in the placement portion, to be movable between an initial position where a tip end part thereof is positioned at a predetermined position on the opposite face side and a protruded position where the tip end part penetrates the through portion and is positioned at a predetermined position on the placement face side, the first folding member folding and moving the sheet member by moving from the initial position to the protruded position in a state in which the sheet member is placed thereon;

a second folding member that is arranged on the placement face side of the placement portion, and pinches and receives the sheet member thus folded as well as the first folding member in a state in which the first folding member is positioned at the protruded position;

a driving mechanism having a rotational driving unit that can output a rotational driving force and a rotating member that is rotated by the rotational driving force from the rotational driving unit, the driving mechanism making the first folding member reciprocate between the initial position and the protruded position;

a rotational position detecting mechanism that detects a rotational position of the rotating member and outputs rotational position information;

a rotational load monitoring unit that detects a rotational load generated in the rotational driving unit and determines whether the rotational load is at least a predetermined load;

a rotational drive control unit that receives the rotational position information from the rotational position detecting mechanism, wherein: the driving mechanism includes a converting unit that converts a rotational motion of the rotating member into a reciprocating motion;

the rotational driving unit can reverse a direction of rotational drive;

the rotating member is directly or indirectly connected to the rotational driving unit; and the rotational drive control unit, when the rotational load monitoring unit determines that the rotational load is at least the predetermined load, determines whether the first folding member is in a state of moving from the initial position to the protruded position or the first folding member is in a state of moving from the protruded position to the initial position based on the rotational position information, and, in a case in which the first folding member is determined to be in the state of moving from the initial position to the protruded position, controls the rotational driving unit to reverse the direction of rotational drive, and in a case in which the first folding member is determined to be in the state of moving from the protruded position to the initial position, controls the rotational driving unit to maintain the direction of rotational drive.

8. A post processing device comprising the folding device according to claim 7, wherein the post processing device is configured to be connectable to an image forming apparatus main body.

9. An image forming apparatus comprising the folding device according to claim 7.

* * * * *